US007796906B2

(12) United States Patent
Yabuta

(10) Patent No.: US 7,796,906 B2
(45) Date of Patent: Sep. 14, 2010

(54) IMAGE FORMING APPARATUS HAVING FIRST AND SECOND IMAGE PROCESSING UNITS AND CORRESPONDING CONVEYANCE PATHS

(75) Inventor: Junko Yabuta, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 723 days.

(21) Appl. No.: 11/717,696

(22) Filed: Mar. 14, 2007

(65) Prior Publication Data

US 2007/0217834 A1 Sep. 20, 2007

(30) Foreign Application Priority Data

Mar. 15, 2006 (JP) ..... 2006-071253
Mar. 28, 2006 (JP) ..... 2006-088958

(51) Int. Cl.
*G03G 15/01* (2006.01)
*G03G 15/00* (2006.01)

(52) U.S. Cl. ..... 399/66; 399/299; 399/388; 399/400

(58) Field of Classification Search ..... 399/66, 399/223, 228, 298, 299, 302, 303, 306, 312, 399/313, 388, 391, 396, 400
See application file for complete search history.

(56) References Cited

U.S. PATENT DOCUMENTS 6,118,956 A * 9/2000 Hirao ..... 399/85
6,853,829 B2 * 2/2005 Hoshi et al. ..... 399/299
7,082,282 B2 * 7/2006 Kaneko ..... 399/309
2007/0242971 A1 * 10/2007 Goto ..... 399/82
2008/0304879 A1 * 12/2008 Tamura ..... 399/307

FOREIGN PATENT DOCUMENTS

JP 61036768 A * 2/1986
JP 62-050867 3/1987
JP 02012274 A * 1/1990
JP 04106559 A * 4/1992
JP 08-072326 3/1996
JP 8-183174 A 7/1996
JP 08272159 A * 10/1996
JP 08-292614 11/1996
JP 08339109 A * 12/1996

(Continued)

*Primary Examiner*—Robert Beatty
(74) *Attorney, Agent, or Firm*—Birch, Stewart, Kolasch & Birch, LLP

(57) ABSTRACT

The image forming apparatus of the present invention includes a first and a second main conveyance path, a first and a second processing unit, a transfer unit, and a fixing unit. The first and second main conveyance paths come together after having branched apart between a paper supply unit and a paper delivery unit. A recording medium is selectively conveyed along either one of the first and second main conveyance path. Image formation is performed by a method of electrophotography by, alternatively, either the first or second processing unit. Between the first and second main conveyance paths where they are branched apart, the transfer unit generates a transfer electric field between itself and one or the other of the first and second processing unit. The fixing unit controls the temperature of a first or a second fixing roller, which are disposed in the first and second main conveyance path after they have come together, alternatively.

20 Claims, 16 Drawing Sheets

FOREIGN PATENT DOCUMENTS

| | | | | |
|---|---|---|---|---|
| JP | 09034181 | A | * | 2/1997 |
| JP | 10020627 | A | * | 1/1998 |
| JP | 10-31342 | A | | 2/1998 |
| JP | 11-327352 | A | | 11/1999 |
| JP | 2000-131993 | A | | 5/2000 |
| JP | 2002-72724 | A | | 3/2002 |
| JP | 2002-192708 | A | | 7/2002 |
| JP | 2002189387 | A | * | 7/2002 |
| JP | 2002-251087 | A | | 9/2002 |
| JP | 2003-36003 | A | | 2/2003 |
| JP | 2004-85746 | A | | 3/2004 |
| JP | 2004070152 | A | * | 3/2004 |
| JP | 2005-165143 | A | | 6/2005 |
| JP | 2005-215459 | A | | 8/2005 |

* cited by examiner

IMAGE FORMING APPARATUS HAVING FIRST AND SECOND IMAGE PROCESSING UNITS AND CORRESPONDING CONVEYANCE PATHS

CROSS REFERENCE

This Nonprovisional application claims priority under 35 U.S.C. §119(a) on Patent Applications No. 2006-071253 and No. 2006-088958 filed in Japan on Mar. 15 and 28, 2006, respectively, the entire contents of which are hereby incorporated by reference.

BACKGROUND OF THE INVENTION

The present invention relates to an image forming apparatus which forms image data upon a recording medium by a method of electrophotography.

As an image forming apparatus which performs both monochrome image formation and color image formation, a composite image forming apparatus has been proposed, as for example disclosed in Japanese Laid-Open Patent Publication Heisei 08-183174 or in Japanese Laid-Open Patent Publication 2002-192708, in which, in consideration of the characteristics of each image formation method and in consideration of the circumstances of use of the color images, an image formation unit which performs monochrome image formation by a method of electrophotography and an image formation unit which performs color image formation by an ink jet method.

When a monochrome image and a color image are formed upon a single recording medium with a composite image forming apparatus according to the prior art, there is a conspicuous disparity in the image quality between the monochrome image which has been formed by the method of electrophotography and the color image which has been formed by the ink jet method, and this gives rise to a sense of discomfort with regard to the visibility of the image.

Due to this, in consideration of increase of the speed of monochrome image formation processing, and in order to create an image with which there is no sense of discomfort when mixing together a monochrome image and a color image in which individual images it has been considered to provide a monochrome image formation unit and a color image formation unit, with both of these image forming units forming images by a method of electrophotography.

However, if a monochrome image formation unit which operates by a method of electrophotography and a color image formation unit which likewise operates by a method of electrophotography are simply provided, this invites increase in size of the apparatus and substantial rise in its cost, due to increase of the number of its component parts. Moreover, the conveyance path for the recording medium becomes more complicated, and the operability with regard to the task of eliminating jamming and the like is deteriorated.

The object of the present invention is to provide an image forming apparatus which can use some members in common in both of two image formation units both of which operate by a method of electrophotography, thus making the device more compact, reducing the number of component parts, simplifying the conveyance path, and implementing enhancement of operability.

SUMMARY OF THE INVENTION

The image forming apparatus of the present invention includes a conveyance path, a first and a second processing unit, a transfer unit, and a fixing unit. The conveyance path is constituted between a paper supply unit and a paper delivery unit, and includes first and second main conveyance paths which branch off at one portion and then come together. According to image data, a recording medium is selectively conveyed along either one of the first main conveyance path and the second main conveyance path. And, according to the image data, image formation is performed by a method of electrophotography by, alternatively, either the first processing unit or the second processing unit. Between the first and second main conveyance paths where they are branched apart, the transfer unit generates a transfer electric field between itself and one or the other of the first processing unit and the second processing unit, according to the image data. And the fixing unit controls the fixing temperature of a first fixing roller or a second fixing roller, which are disposed in the first and the second main conveyance path after they have come together, alternatively, according to the image data.

DETAILED DESCRIPTION OF THE INVENTION

Figure 1:
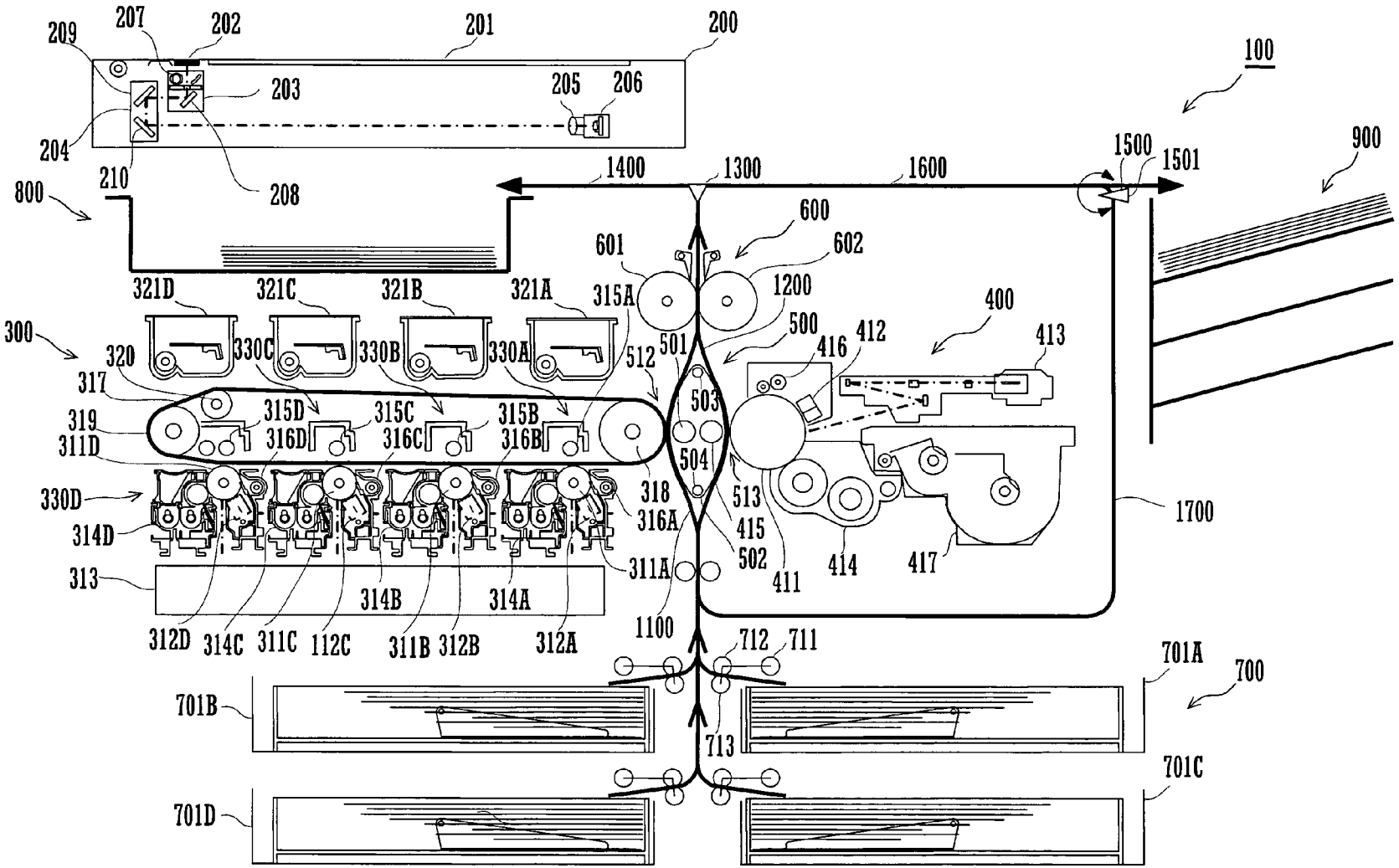
FIG. 1 is a schematic figure showing the structure of an image forming apparatus according to an embodiment of the present invention.

In the following, image forming apparatuses according to several preferred embodiments of the present invention will be described in detail with reference to the drawings. FIG. 1 is a schematic figure showing the structure of an image forming apparatus 100 according to an embodiment of the present invention. This image forming apparatus comprises a scanner unit 200, a color processing unit 300 (a first processing unit), a monochrome processing unit 400 (a second processing unit), a transfer unit 500, a fixing unit 600, a paper supply unit 700, a first paper delivery unit 800, and a second paper delivery unit 900.

As an example, the scanner unit 200 is disposed in the uppermost portion of the image forming apparatus 100. And the color processing unit 300 and the monochrome processing unit 400 are disposed in line along the horizontal direction of an intermediate section of the image forming apparatus 100. Moreover, the transfer unit 500 and the fixing unit 600 are disposed between the color processing unit 300 and the monochrome processing unit 400. The fixing unit 600 is disposed over the transfer unit 500.

A paper supply unit 700 is disposed in the lowermost portion of the image forming apparatus 100, and stores various types of paper which it supplies to the processing units 300,400 during image formation. As these types of paper, which constitute recording media, there may be included, for example, ordinary paper, recycled paper, OHP sheets, thick paper sheets such as postcards and the like, envelopes, and so on. A first paper delivery unit 800 is disposed between the scanner unit 200 and the color processing unit 300. And a second paper delivery unit 900 is disposed on the right side of the monochrome processing unit 400.

A first main conveyance path 1100 and a second main conveyance path 1200 are defined from the paper supply unit 700 and via the transfer unit 500 and the fixing unit 600 up to a first branch off portion 1300. The first main conveyance path 1100 passes on the color processing unit side of the transfer unit 500. And the second main conveyance path 1200 passes on the monochrome processing unit 400 side of the transfer unit 500.

A first paper discharge conveyance path 1400 is defined from the first branch off portion 1300 to the first paper delivery unit 800. And a second paper discharge conveyance path 1600 is defined from the first branch off portion 1300 via a second branch off portion 1500 to the second paper delivery unit 900. Moreover, an auxiliary conveyance path 1700 is defined from the second branch off unit 1500 to between the paper supply unit 700 and the transfer unit 500.

The first main conveyance path 1100 and the second main conveyance path 1200 take the same route, except for passing on opposite sides of the transfer unit 500. The first main conveyance path 1100, the second main conveyance path 1200, the first paper discharge conveyance path 1400, and the second paper discharge conveyance path 1600 correspond to the "conveyance path" of the Claims.

The scanner unit 200 comprises a first platen 201, a second platen 202, a first mirror base 203, a second mirror base 204, a lens 205, and a CCD sensor 206. The first platen 201 and the second platen 202 are made as hard glass members. A document of which an image is to be read in is mounted upon the upper surface of the first platen 201 by manual actuation, or by an automatic document feeder not shown in the figures. Or, a document of which an image is to be read in may be passed over the upper surface of the second platen 202 by an automatic document feeder not shown in the figures.

The first mirror base 203 supports a lamp 207 and a first mirror 208. And the second mirror base 204 supports a second mirror 209 and a third mirror 210. When reading in an image of a document which is mounted upon the upper surface of the first platen 201, the first mirror base 203 and the second mirror base 204 are shifted in the horizontal direction along the lower surface of the first platen 201. At this time, the second mirror base 204 shifts at half the speed of the first mirror base 203. And, when reading in an image of a document which is passing over the upper surface of the second platen 202, the first mirror base 203 is stopped at a position below the second platen 202.

The lamp 207 irradiates light upon the image surface of the document. The mirrors 208 through 210 deflect the light reflected by the image surface of the document towards the lens 205. The lens 205 images the reflected light upon a light receiving surface of a CCD sensor 206. The CCD 206 outputs a received light signal which corresponds to the amounts of light in the light which it has received. After this received light signal has been converted into digital data by a control unit 110 which will be described hereinafter, it is subjected to predetermined image processing and then is stored as image data.

The color processing unit 300 forms a color image based upon image data of a color document which has been read in by the scanner unit 200, or upon color image data which has been inputted from the exterior. This color processing unit 300 comprises photoreceptor drums 311A through 311D, an electrification devices 312A through 312D, an exposure unit 313, development devices 314A through 314D, transfer devices 315A through 315D, cleaners 316A through 316D, an intermediate transfer belt 317, and toner hoppers 321A through 321D.

In this color processing unit 300, there are defined four processing stations 330A through 330D, each of which forms an image of a different hue. These processing stations 330A through 330D respectively form a black colored image and images of the hues cyan, magenta, and yellow, which are the three primary colors of subtractive color mixing.

The processing station 330A which forms the black colored image comprises the photoreceptor drum 311A, the electrification device 312A, the development device 314A, the transfer device 315A, the cleaner 316A, and the toner hopper 321A. The photoreceptor drum 311A has a photoreceptor layer around its circumferential surface, and rotates in the clockwise in FIG. 1. And the electrification device 312A electrifies the circumferential surface of the photoreceptor drum 311A uniformly.

The exposure unit 313 exposes each of the photoreceptor drums 311A through 311D with laser light which has been modulated based upon the image data for each of the hues. The circumferential surface of the photoreceptor drum 311A which has experienced this electrification by the electrification device 312A is exposed by the laser light according to the black colored image data in a principal scanning direction, which is parallel to the axial direction of the photoreceptor drum 311A. Due to this exposure to the laser light, an electrostatic latent image corresponding to the black colored image data is generated upon the circumferential surface of the photoreceptor drum 311A.

The development device 314A supplies black colored toner to the circumferential surface of the photoreceptor drum 311A, upon which this electrostatic latent image has thus been generated. And thereby the electrostatic latent image upon the circumferential surface of the photoreceptor drum 311A is developed by this black colored toner into a toner image.

The intermediate transfer belt 317 corresponds to the "first image carrying member" of the Claims, and is an endless belt which is extended over a drive roller 318, a driven roller 319, and a tension roller 320. Due to the rotation of the drive roller 318, this intermediate transfer belt 317 is circulated in order past the processing station 330D, the processing station 330C, the processing station 330B, and the processing station 330A.

In the processing station 330A, the intermediate transfer belt 317 passes between the photoreceptor drum 311A and the transfer device 315A. And the transfer device 315A transcribes the black colored toner image which is carried upon the circumferential surface of the photoreceptor drum 311A to the surface of the intermediate transfer belt 317.

The cleaner 316A removes the toner which remains upon the circumferential surface of the photoreceptor drum 311A after it has opposed the intermediate transfer belt 317, from the circumferential surface of the photoreceptor drum 311A.

The toner hopper 321A stores black colored toner for replenishing the development device 314A. When the amount of black colored toner within the development device 314A becomes low, then black colored toner is replenished into the development device 314A from the toner hopper 321A via a replenishment path not shown in the figures.

The processing stations 330A through 330D all have the same structure, except for the fact that toners of mutually different hues are stored in their development devices 314A through 314D and their toner hoppers 321A through 321D. Just as in the case of the processing station 330A, in each of the processing stations 330B through 330D as well, a cyan, magenta, or yellow toner image is similarly transcribed to the surface of the intermediate transfer belt 317. And these yellow, magenta, cyan, and black colored toner images are transcribed in order, superimposed upon one another, to the surface of the intermediate transfer belt 317 which is passing through the processing stations 330A through 330D, so that a toner image in full color is formed.

The monochrome processing unit 400 forms a monochrome image based upon image data of a document which has been read in by the scanner unit 200, or based upon image data which has been inputted from the exterior. This monochrome processing unit 400 comprises a photoreceptor drum 411, an electrification device 412, an exposure unit 413, a development device 414, a cleaner 417, and a toner hopper 417.

The photoreceptor drum 411 corresponds to the "second image carrying member" of the Claims, and has a photoreceptor layer upon its circumferential surface and is rotated in the clockwise in FIG. 1. And the electrification device 412 electrifies the circumferential surface of the photoreceptor drum 411 uniformly. The exposure unit 413 exposes the circumferential surface of the photoreceptor drum 411 with laser light which has been modulated based upon the image data. The circumferential surface of the photoreceptor drum 411 which has experienced this electrification by the electrification device 412 is exposed by the laser light according to the image data in a principal scanning direction, which is parallel to the axial direction of the photoreceptor drum 411. Due to this exposure to the laser light, an electrostatic latent image corresponding to the image data is generated upon the circumferential surface of the photoreceptor drum 411.

The development device 414 supplies black colored toner to the circumferential surface of the photoreceptor drum 411, upon which this electrostatic latent image has thus been generated. And thereby the electrostatic latent image upon the circumferential surface of the photoreceptor drum 411 is developed by this black colored toner into a toner image.

The transfer device 415 transcribes the black colored toner image which is carried upon the circumferential surface of the photoreceptor drum 411 to the surface of a sheet of paper which is passing between itself and the photoreceptor drum 411. And the cleaner 416 removes the toner which remains upon the circumferential surface of the photoreceptor drum 411 after it has opposed the paper sheet, from the circumferential surface of the photoreceptor drum 411.

The toner hopper 417 stores black colored toner for replenishing the development device 414. When the amount of black colored toner within the development device 414 becomes low, then black colored toner is replenished into the development device 414 from the toner hopper 417 via a replenishment path not shown in the figures.

The transfer unit 500 is disposed between the color processing unit 300 and the monochrome processing unit 400. In addition to the transfer device 415 described above, this transfer unit 500 comprises a transfer device 501, a conveyance belt 502, a drive roller 503, and a driven roller 504. The transfer device 415 and the transfer device 501 are cylindrical shaped transfer rollers, and are rotatably the clockwise and the counterclockwise in FIG. 1, respectively. The transfer device 415 and the transfer device 501 may, for example, be made from metal or an electrically conductive resin, or from a combination thereof; and they may be plate shaped, or may be rollers. The transfer device 501 corresponds to the "first transfer device" of the Claims, while the transfer device 415 similarly corresponds to their "second transfer device".

A conveyance path comprises the conveyance belt 502, and the drive roller 503 and driven roller 504 which constitute the "plurality of rollers" of the Claims. The drive roller 503 is the "first roller" of the Claims, and similarly the driven roller 504 is the "second roller" of the Claims. The conveyance belt 502 is an endless belt which bridges between the transfer device 415, the transfer device 501, the drive roller 503, and the driven roller 504. This conveyance belt 502 has a predetermined resistance value which may be set to, for example, $1.0\times10^{8}$~$1.0\times10^{13}$ Ω·cm.

The drive roller 503 is connected to a drive power source (not shown in the drawings), and is driven in the clockwise or the counterclockwise in FIG. 1. As one possible example, a DC brushless motor or a stepping motor may be used as this drive power source. During color image formation in which the color processing unit 300 is being used, the drive roller 503 is driven in the clockwise in FIG. 1. However, during monochrome image formation in which the monochrome processing unit 400 is being used, the drive roller 503 is driven in the counterclockwise in FIG. 1. The transfer device 415 is pressed into contact with the circumferential surface of the photoreceptor drum 411, with the conveyance belt 502 being sandwiched between them. And the transfer device 501 is pressed into contact with the intermediate transfer belt 317, with the conveyance belt 502 being sandwiched between them.

The portion of the conveyance belt 502 which is sandwiched between the transfer device 501 and the intermediate transfer belt 317 constitutes a first opposing portion 512 thereof, and the surface region of this first opposing portion 512 on its side which opposes the intermediate transfer belt 317 is the opposing surface of this first opposing portion 512. The transfer device 501 is positioned at this first opposing portion 512 of the conveyance belt 502, on the side of the rear surface thereof. And the portion of the conveyance belt 502 which is sandwiched between the transfer device 415 and the photoreceptor drum 411 constitutes a second opposing portion 513 thereof, and the surface region of this second opposing portion 513 on its side which opposes the photoreceptor drum 411 is the opposing surface of this second opposing portion 513. The transfer device 415 is positioned at this second opposing portion 513 of the conveyance belt 502, on the side of the rear surface thereof.

By employing this structure, it is possible to increase the amount by which the transfer units upon the conveyance paths are used in common by the two processing units; and, as a result, it is possible to anticipate that the transfer mechanism may be made more compact, and also shortening of the conveyance path, reduction of the number of component parts, and enhancement of the ease of use.

As an example, paper supply cassettes 701A through 701D may be fitted to the paper supply unit 700. Each of these paper supply cassettes 701A through 701D stores a predetermined number of paper sheets of a single size. A pickup roller 711, a paper supply roller 712, and a separation roller 713 are provided to each of the paper supply cassettes 701A through 701D. By the action of these pickup rollers 711, paper supply rollers 712, and separation rollers 713, sheets of paper may be supplied one at a time to the first main conveyance path 1100 or the second main conveyance path 1200 from any one of the paper supply cassettes 701A through 701D.

During color image formation, the transfer device 501 transcribes a full color toner image upon the intermediate transfer belt 317 to a sheet of paper as it passes the first opposing portion 512 provided midway along the first conveyance path 1100. And, during monochrome image formation, the transfer device 415 transcribes a monochrome toner image upon the circumferential surface of the photoreceptor drum 411 to a sheet of paper as it passes the second opposing portion 513 provided midway along the second conveyance path 1200.

The fixing unit 600 comprises a pair of fixing rollers 601 and 602, which correspond to the "first and second fixing rollers" of the Claims. These fixing rollers 601 and 602 are pressed together in mutual contact. And these fixing rollers 601 and 602 apply heat to the paper upon which the toner image has been transcribed and pressurize it, thus fixing the toner image upon the surface of the paper.

The sheet of paper which has passed the fixing unit 600 is branched off by the first branch off unit 1300, and either passes along the first paper discharge conveyance path 1400 and is discharged to the first paper delivery unit 800, or passes along the second paper discharge conveyance path 1600 and is discharged to the second paper delivery unit 900. During color image formation, sheets of paper are discharged to the first paper delivery unit 800 with their image surfaces facing downwards (face down discharge), while sheets of paper are discharged to the second paper delivery unit 900 with their image surfaces facing upwards (face up discharge). And, during monochrome image formation, sheets of paper are discharged to the first paper delivery unit 800 with their image surfaces facing upwards (face up discharge), while sheets of paper are discharged to the second paper delivery unit 900 with their image surfaces facing downwards (face down discharge).

During double sided image formation in which images are to be formed on both sides of the paper, a paper sheet which has passed the fixing unit 600 and upon which single sided image formation has been completed, after having been switched back with the first paper discharge conveyance path 1400, passes along the second paper discharge conveyance path 1600 and is directed into the auxiliary conveyance path 1700 by the second branch off unit 1500.

A rotatable paper discharge gate 1501 is provided to the second branch off unit 1500. The attitude of this paper discharge gate 1501 can be changed over, and thereby the conveyance direction can be changed over, so that the paper sheet may be directed, either towards the second paper delivery unit 900, or towards the auxiliary conveyance path 1700.

Figure 2A:
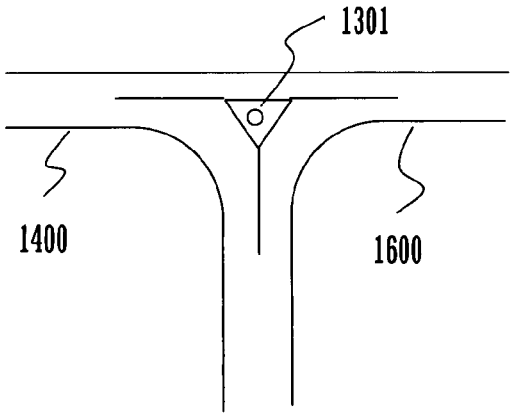
FIG. 2A is a figure showing the initial state of a three way gate of the image forming apparatus.

FIGS. 2A to 2D are enlarged views of the first branch off unit 1300. A rotatable three way gate 1301 is provided in the neighborhood of the central portion of this first branch off unit 1300. FIG. 2A shows the initial state of this three way gate 1301. A flexible member made from a resin sheet or the like, and which is elongated in the three directions rightwards, leftwards, and downwards, is provided to this three way gate 1301.

Figure 2B:
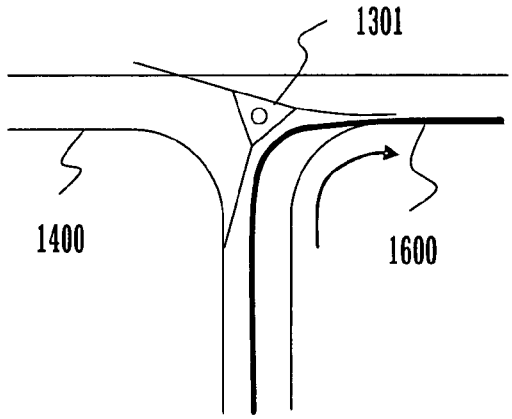
FIG. 2B is a figure showing the state of the three way gate of this image forming apparatus when a sheet of paper is being conveyed in the direction of a second paper discharge conveyance path.

FIG. 2B shows the state of this three way gate 1301 when a sheet of paper which has arrived by being conveyed from the fixing unit 600 is being conveyed in the direction of the second paper discharge conveyance path 1600. The three way gate 1301 is rotated in the clockwise from its initial state shown in FIG. 2A, and thereby the paper sheet, which has arrived by being conveyed from the fixing unit 600 after the image upon it has been fixed, is directed to be forwarded into the second paper discharge conveyance path 1600.

Figure 2C:
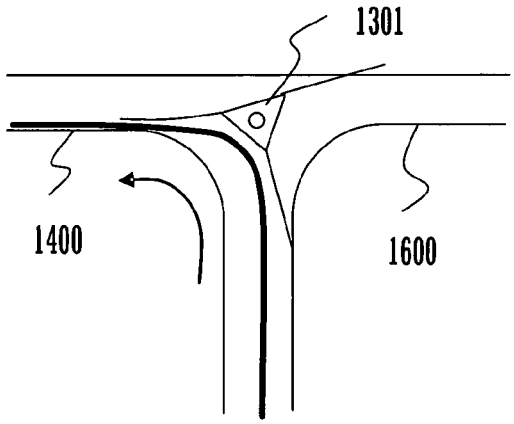
FIG. 2C is a figure showing the state of the three way gate of this image forming apparatus when a sheet of paper is being conveyed in the direction of a first paper discharge conveyance path.

FIG. 2C shows the state of the three way gate 1301 when a sheet of paper which has arrived by being conveyed from the fixing unit 600 is being conveyed in the direction of the first paper discharge conveyance path 1400. The three way gate 1301 is rotated in the counterclockwise from its initial state shown in FIG. 2A, and thereby the paper sheet, which has arrived by being conveyed from the fixing unit 600 after the image upon it has been fixed, is directed to be forwarded into the first paper discharge conveyance path 1400.

Figure 2D:
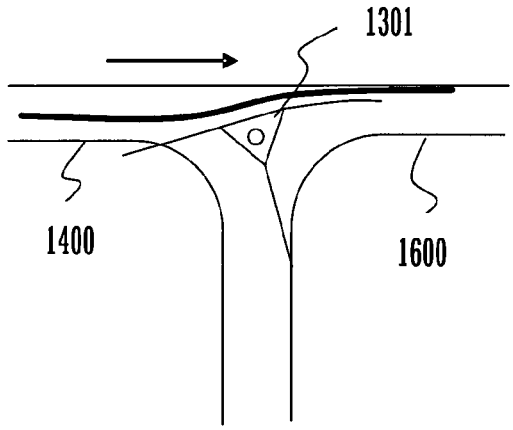
FIG. 2D is a figure showing the state of the three way gate of this image forming apparatus when a sheet of paper is being conveyed in the direction of the second paper discharge conveyance path.

And FIG. 2D shows the state of the three way gate 1301 when a sheet of paper, which has been switch back conveyed from the first paper discharge conveyance path 1400, is being conveyed in the direction of the second paper discharge conveyance path 1600. The three way gate 1301 is rotated in the anti-clockwise from its initial state, and thereby the paper sheet, which has arrived by being switch back conveyed from the first paper discharge conveyance path 1400, is directed to be forwarded into the second paper discharge conveyance path 1600.

By providing the first branch off unit 1300, the second branch off unit 1500, the first paper discharge conveyance path 1400, the second paper discharge conveyance path 1600, and the auxiliary conveyance path 1700 to this image forming apparatus 100, it is possible to perform face down discharge and face up discharge of paper sheets during color image formation and during monochrome image formation, and moreover it is possible to perform double sided image formation upon the paper sheets.

Figure 3A:
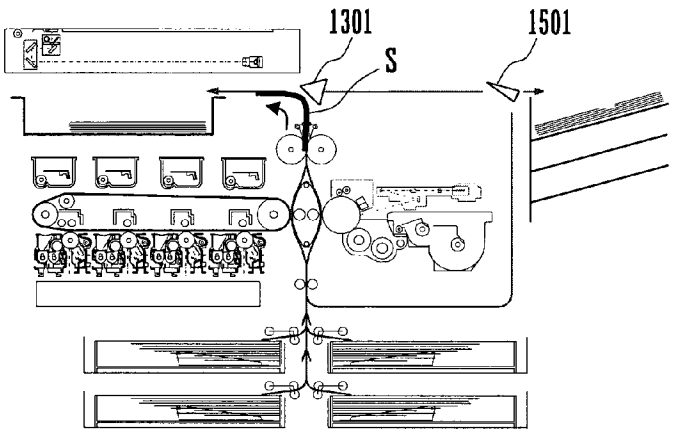
FIG. 3A is a figure showing the state of this image forming apparatus during double sided image formation, when a sheet of paper is being conveyed in the direction of the first paper discharge conveyance path.
Figure 3B:
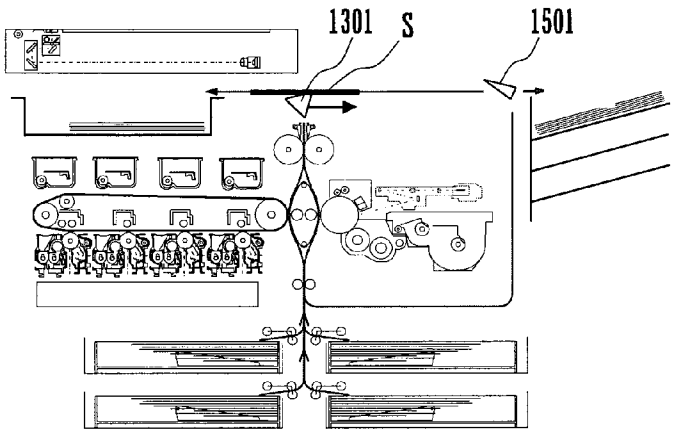
FIG. 3B is a figure showing the state of this image forming apparatus during double sided image formation, when this sheet of paper is being switch back conveyed towards the second paper discharge conveyance path.
Figure 3C:
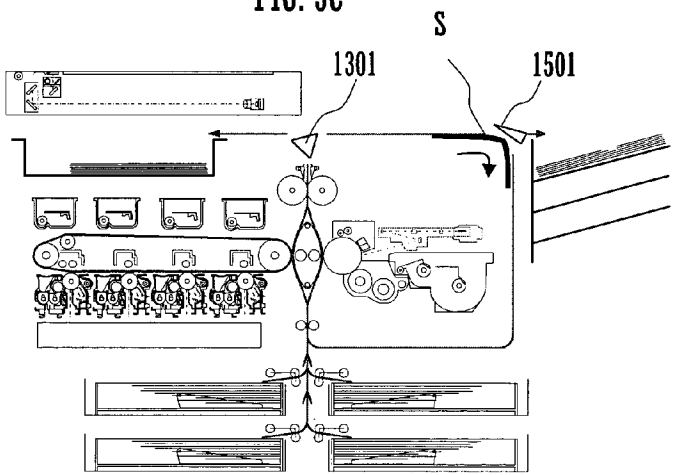
FIG. 3C is a figure showing the state of this image forming apparatus during double sided image formation, when this sheet of paper is being conveyed towards an auxiliary conveyance path.
Figure 3D:
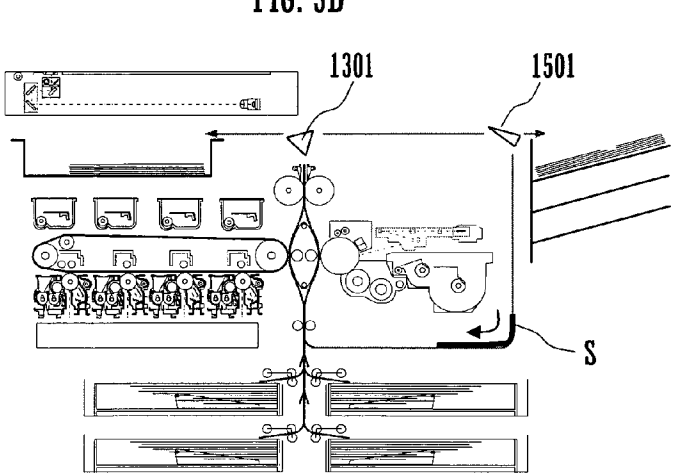
FIG. 3D is a figure showing the state of this image forming apparatus during double sided image formation, when this sheet of paper is being conveyed towards a processing unit for a second time.

FIGS. 3A through 3D show states of the paper conveyance during double sided image formation. As shown in FIG. 3A, a sheet of paper S upon a first side of which a toner image has been transcribed by the color processing unit 300 or by the monochrome processing unit 400 is directed into the first paper discharge conveyance path 1400 by the three way gate 1301 being rotated from its initial state in the counterclockwise. A conveyance roller not shown in the figures is provided at an intermediate point in the first paper discharge conveyance path 1400, and this conveys the sheet of paper S in the leftwards direction in the figure. The paper discharge gate 1501 waits in an attitude suitable for directing this sheet of paper S towards the auxiliary conveyance path 1700. When the trailing edge of the sheet of paper S has passed the branch off unit 1300, as shown in FIG. 3B, the direction of conveyance by the conveyance roller in the first paper discharge conveyance path 1400 is changed over, and thereby the sheet of paper S is switch back conveyed towards the second paper discharge conveyance path 1600. When this sheet of paper S reaches the second branch off unit 1500, as shown in FIG. 3C, it is directed towards the auxiliary conveyance path 1700 by the paper discharge gate 1501, and, as shown in FIG. 3D, it is conveyed for a second time towards its processing unit. Image formation is performed upon the other surface of the sheet of paper S by the color processing unit 300 or by the monochrome processing unit 400, and then this sheet of paper S, upon both sides of which images have now been formed, is finally discharged to the first paper delivery unit 800 or the second paper delivery unit 900.

Figure 4:
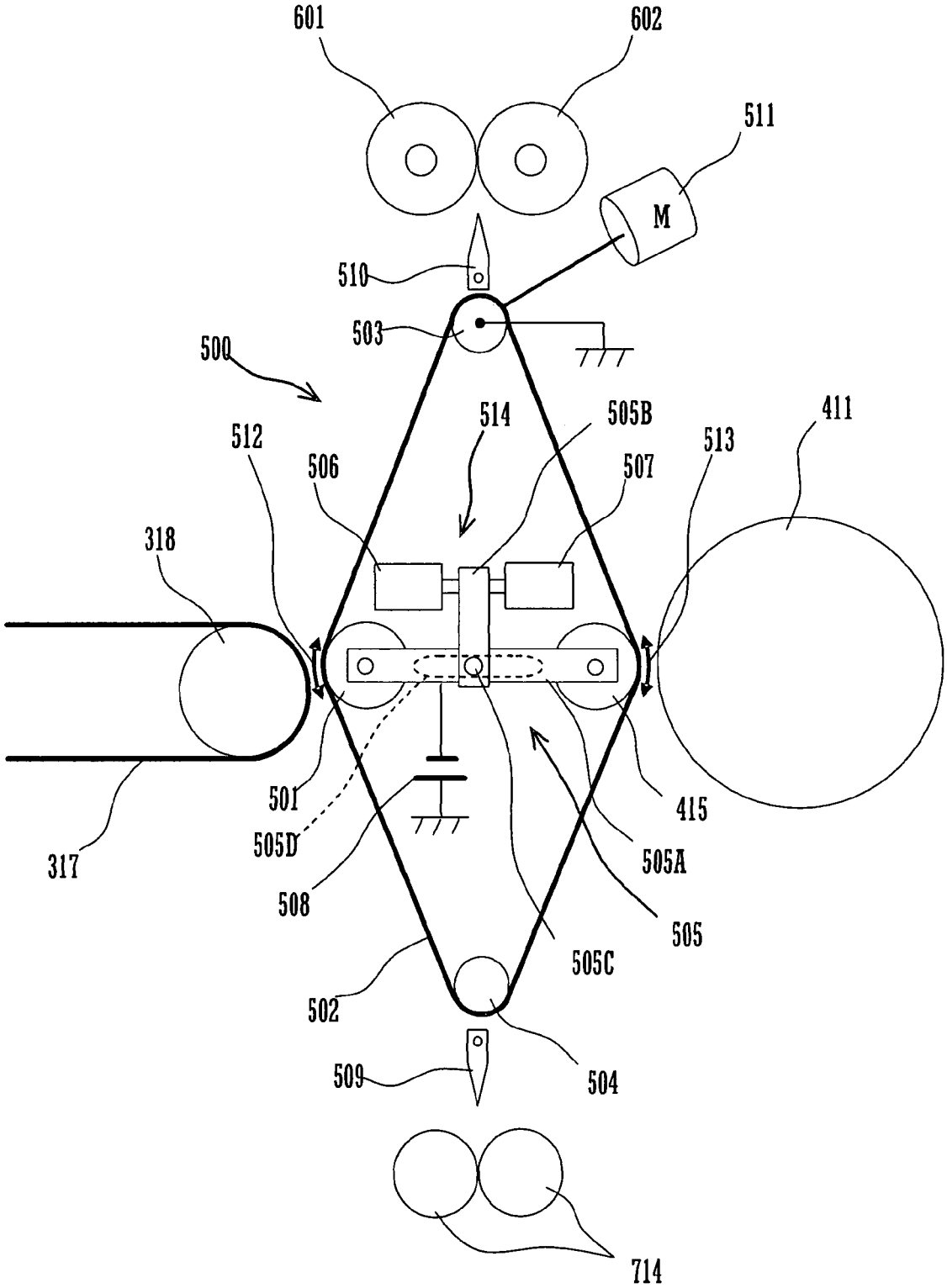
FIG. 4 is a figure showing the detailed structure of a transfer unit of the image forming apparatus.

FIG. 4 is a figure showing the detailed structure of the transfer unit 500. This transfer unit 500 is a device for transcribing a toner image upon a paper sheet which has been conveyed to the first opposing portion 512 or the second opposing portion 513, and it comprises the transfer device 415, the transfer device 501, a support member 505, a high voltage power supply 508, and a shift member 514.

An output terminal of the high voltage power supply 508 is connected to the transfer device 501 and to the transfer device 415, and thereby a common high voltage is supplied to these transfer devices. The high voltage output is shared in common by the first and second transfer devices 501 and 415, so that it is possible for them to share the output transformer of the high voltage power supply in common, and thereby it is possible to minimize the size of the circuit for high voltage power supply.

The drive roller 503 is connected to the motor 511, which is a drive power source, and thereby the drive roller 503 can be rotated in either direction.

The drive roller 503 is provided at the downstream side of the conveyance belt 502 in the direction of conveyance of the paper, and is grounded. On the other hand, the driven roller 504 is provided at the upstream side of the conveyance belt 502 in the direction of conveyance of the paper, and is set to an electrically floating state. After transfer has been completed, the surface electrical potential of the conveyance belt 502 is thereby able to decrease towards the neighborhood of ground electrical potential, so that the paper sheet, which is being conveyed upon the conveyance belt 502 by electrostatic attraction, can simply and easily be peeled off from the conveyance belt 502.

The second roller 504 is provided at the upstream side of the conveyance belt 502 in the direction of conveyance, and is set to an electrically floating state. Being in a floating state means that it is not connected to any electrical circuit having any specified electrical potential, and is not grounded either. Due to this roller 504 on the upstream side being put into a floating state, the paper sheets which are supplied from the paper supply unit 700 are electrostatically attracted to the conveyance belt 502 by the electric field which is generated by the electric charges which are shifted from the high voltage power supply 508 via the transfer device 501 or the transfer device 415 in the upstream direction of the conveyance belt 502, and thereby stable conveyance of the paper sheets becomes possible.

The support member 505 supports the transfer device 501 and the transfer device 415 so that they are supported rotatably, and is provided between the transfer device 501 and the transfer device 415. This support member 505 comprises a first shift shaft 505A, a second shift shaft 505B, and a support shaft 505C. The transfer device 501 and the transfer device 415 are supported by the first shift shaft 505A which is positioned between the transfer device 501 and the transfer device 415, so as to be free to rotate, while the second shift shaft 505B is provided at the central portion of the first shift shaft 505A in its longitudinal direction. This second shift shaft 505B is capable of supported movably in the left and right direction in the figure.

The shift member 514 comprises a solenoid 506 and a solenoid 507. The solenoid 506 and the solenoid 507 are fitted to the second shift shaft 505B. In the shift member 514, the solenoid 506 or the solenoid 507 is selectively driven, according to the image data. The transfer device 501 and the transfer device 415 shift in correspondence to which of the processing units is to perform image formation, so that the one of the processing units, i.e. that one of the first processing unit 300 and the second processing unit 400, which is to perform image formation is pressed into contact with the endless belt 502, while that one of the processing units which is not to perform image formation is removed away from the endless belt 502.

The support shaft 505C from the center of the first shift shaft 505A is provided as extending in the direction perpendicular to the drawing paper in FIG. 4, and this support shaft 505C is supported by a long hole 505D which is provided in a portion of the frame of the image forming apparatus 100. The support member 505 extends along the longitudinal direction of this long hole 505D, and shifts due to the drive force of the solenoid 506 and the solenoid 507.

The pressing contact force of the transfer device 501 and the transfer device 415 due to the solenoid 506 and the solenoid 507 constitutes the pressing contact force with which a transfer region is created of a nip width over which the image data can be transcribed to the recording medium.

The paper stop rollers 714 grip the paper sheet which is brought in to this transfer unit 500.

Figure 5:
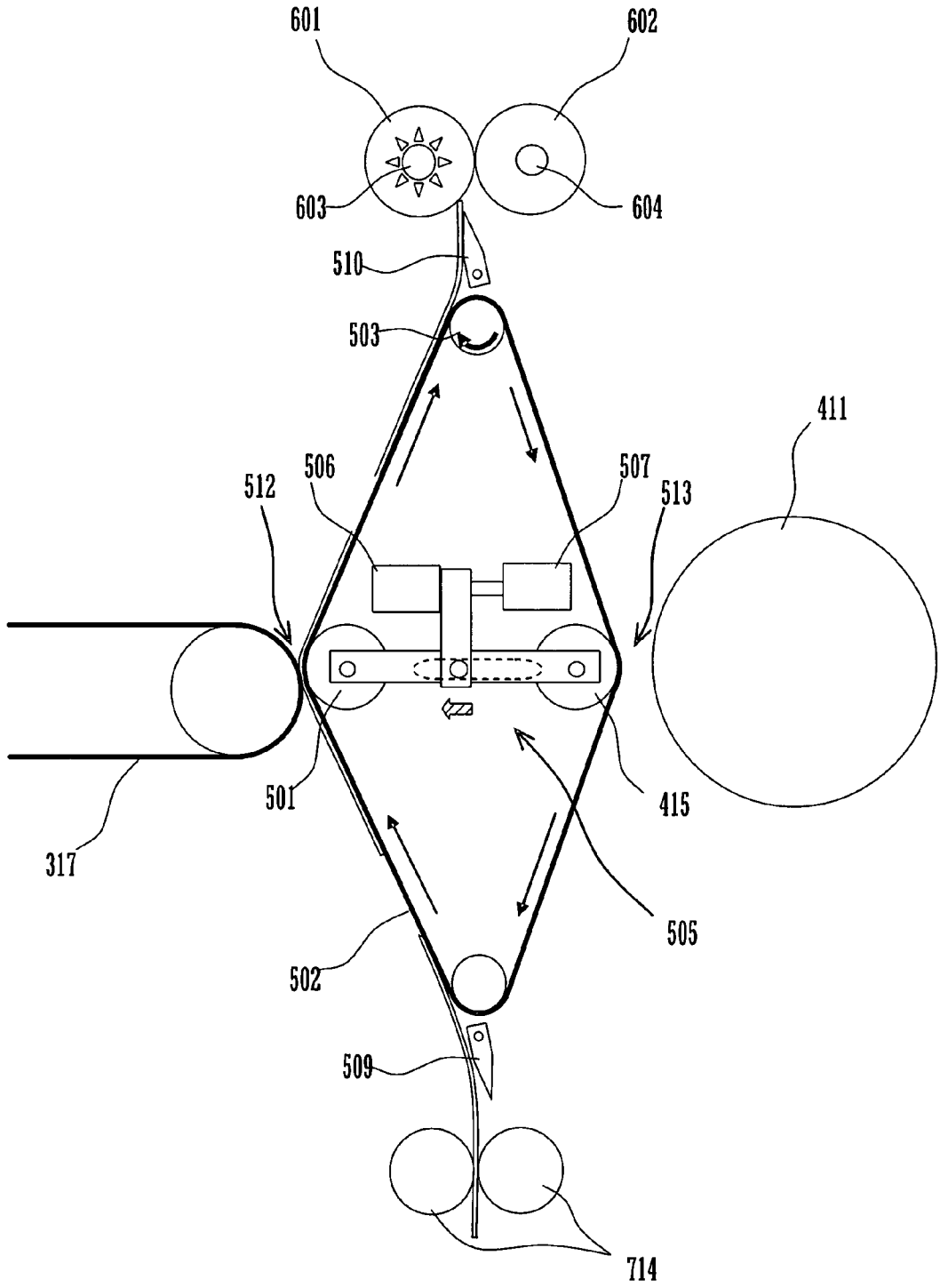
FIG. 5 is a figure showing the operation of the embodiment of the image forming apparatus of the present invention during color image formation.
Figure 6:
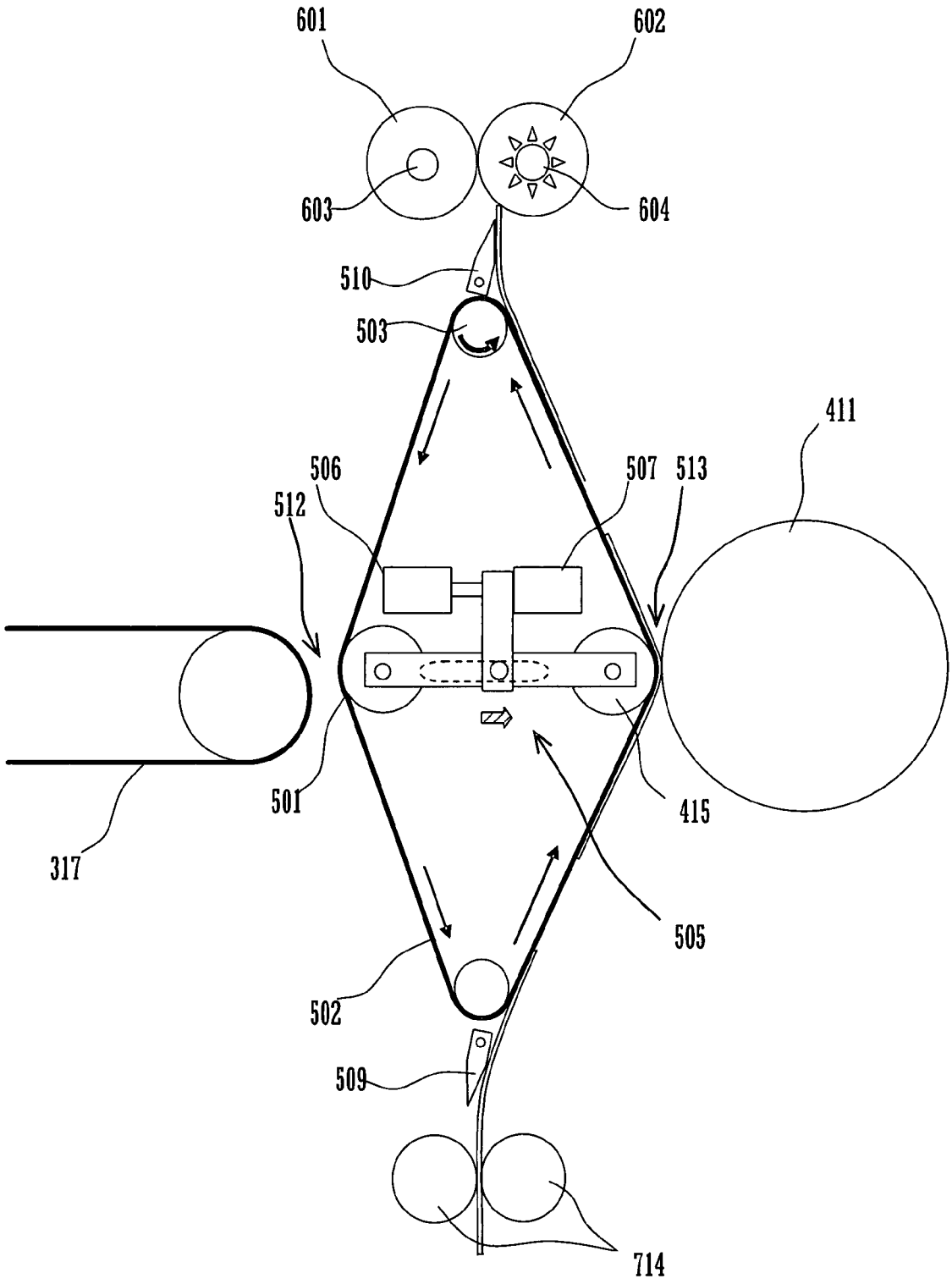
FIG. 6 is a figure showing the operation of the embodiment of the image forming apparatus of the present invention during monochrome image formation.

FIGS. 5 and 6 are figures showing the state of shifting of the transfer device 501 and the transfer device 415 by the shift members.

The situation when creating a toner image with the color processing unit 300 and performing transfer thereof onto a paper sheet is shown in FIG. 5. When the support member 505 is shifted in the leftwards direction in FIG. 5 by turning the solenoid 5060N (i.e. supplying it with power) and turning the solenoid 507 OFF (i.e. cutting it off), then the transfer device 501 is pressed into contact with the intermediate transfer belt 317 via the conveyance belt 502, and at the same time the transfer device 415 is removed away from the photoreceptor drum 411. It is possible for the support member 505 and the solenoids 506 and 507 to be utilized by the two transfer devices 501 and 415 in common, and thereby it is possible to simplify the mechanism for shifting the transfer devices 501 and 415, and the control for performing the shifting. Furthermore, the tension of the conveyance belt 502 is always maintained constant before the shifting of the transfer devices 501 and 415, and during the period of shifting, and looseness of this belt never takes place.

The motor 511 is controlled so as to rotate the drive roller 503 in the clockwise in FIG. 5. At this time, a first gate 509, which is the "conveyance direction changeover means" of the Claims, is rotated in the counterclockwise, and thereby the direction of conveyance of a paper sheet which has been supplied from the paper supply unit 700 and has been gripped by the paper stop rollers 714 is changed over to the leftwards direction of the conveyance belt 502, so that the paper sheet is conveyed towards the first opposing portion 512. By doing this, it is possible to simplify the drive mechanism and the drive control of the conveyance mechanism when sharing a single transfer unit between two processing units.

A second gate 510, which is the "conveyance direction change means" of the Claims, is rotated in the anti-clockwise, so that the conveyance direction of a paper sheet which has passed the first opposing portion 512 and upon which the transfer process has been completed is changed to a direction which is closer to the fixing roller 601 than the position where the fixing rollers 601 and 602 are pressed together in mutual contact. During image formation by the color processing unit 300, the control unit 110 supplies electricity to a heater 603 which is provided in the interior of this fixing roller 601, and thereby the surface of the fixing roller 601 is heated up to a predetermined temperature, and fixes the toner upon the surface of the paper sheet. By changing over the conveyance direction of the paper sheet in this manner to a direction which is closer to the fixing roller 601 than the position where the fixing rollers 601 and 602 are pressed together into mutual contact, it is possible to supply the heat which is generated in the fixing roller 601 to the paper sheet in advance before it enters into the position where the fixing rollers 601 and 602 are pressed together into mutual contact, so that the quality of the fixing process is thereby enhanced.

The situation when creating a toner image with the monochrome processing unit 400 and performing transfer thereof onto a paper sheet is shown in FIG. 6. When the support member 505 is shifted in the rightwards direction in FIG. 6 by turning the solenoid 506 OFF and turning the solenoid 5070N, then the transfer device 501 is removed away from the intermediate transfer belt 317, and at the same time the transfer device 415 is pressed into contact with the photoreceptor drum 411 via the conveyance belt 502.

And the control unit 110 controls the motor 511 so as to rotate the drive roller 503 in the counterclockwise in FIG. 6. At this time the first gate 509, which is the "changeover means" of the Claims, is rotated in the clockwise, and thereby the direction of conveyance of a paper sheet which has been supplied from the paper supply unit 700 and has been gripped by the paper stop rollers 714 is changed over to the rightwards direction of the conveyance belt 502, so that the paper sheet is conveyed towards the second opposing portion 513.

The second gate 510, which is the "change means" of the Claims, is rotated in the clockwise, so that the conveyance direction of a paper sheet which has passed the second opposing portion 513 and upon which the transfer process has been completed is changed to a direction which is closer to the fixing roller 602 than the position where the fixing rollers 601 and 602 are pressed together in mutual contact. During image formation by the monochrome processing unit 400, the control unit 110 supplies electricity to a heater 604 which is provided in the interior of this fixing roller 602, and thereby the surface of the fixing roller 602 is heated up to a predetermined temperature, and fixes the toner upon the surface of the paper sheet. By changing over the conveyance direction of the paper sheet in this manner to a direction which is closer to the fixing roller 602 than the position where the fixing rollers 601 and 602 are pressed together into mutual contact, it is possible to supply the heat which is generated in the fixing roller 602 to the paper sheet in advance before it enters into the position where the fixing rollers 601 and 602 are contact with pressure each other, so that the quality of the fixing process is thereby enhanced.

The distance between the conveyance belt 502 and the photoreceptor drum 411 when the transfer device 415 has been removed from the photoreceptor drum 411 is made to be a distance at which the toner which remains upon the photoreceptor drum 411 is not transcribed to the conveyance belt 502 by the electric field which is generated by the transfer device 415, and at which the electric charges originating in this electric field are not transferred to the photoreceptor drum 411. In the same manner, the distance between the conveyance belt 502 and the intermediate transfer belt 317 when the transfer device 501 has been removed from the intermediate transfer belt 317 is made to be a distance at which the toner which remains upon the intermediate transfer belt 317 is not transcribed to the conveyance belt 502 by the electric field which is generated by the transfer device 502, and at which the electric charges originating in this electric field are not transferred to the intermediate transfer belt 317. Although any distance will be acceptable, in concrete terms a distance of 3~5 mm is appropriate. When a common transfer voltage is applied to the transfer device 501 and the transfer device 415, although electric fields are generated from both of the two transfer devices 501 and 415 at the same time, no useless electric change is transferred to the processing unit which is not performing any transfer process, or to the portion of the conveyance belt 502 on the side of the processing unit which is not performing any transfer process. Furthermore, transference to the conveyance belt 502 of toner remaining upon the processing unit which is not performing any transfer process, and contamination of the conveyance belt 502 thereby, can be prevented.

The color processing unit 300 and the monochrome processing unit 400 differ with regard to their printing processing speed, and, in fact, the monochrome processing unit 400 is set to a slower printing processing speed than the color processing unit 300. The motor 511 is controlled, and the conveyance speed by the conveyance belt 502 is controlled, so as to accord with the respective printing processing speed of each of the processing units.

Figure 7:
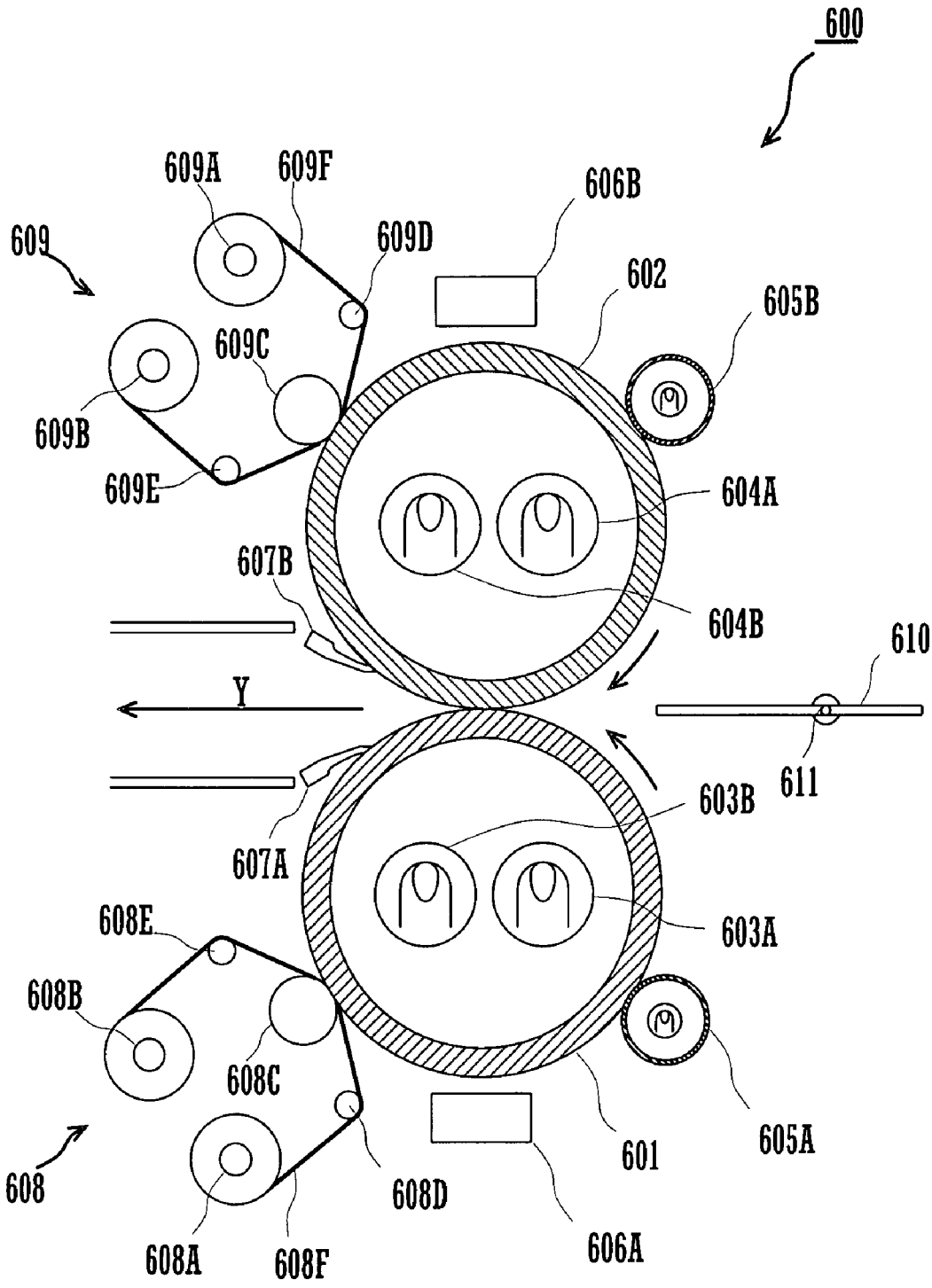
FIG. 7 is a front sectional view of a fixing unit, which is a fixing device.

FIG. 7 is a front sectional view of the fixing unit 600. This fixing unit 600 comprises the fixing rollers 601 and 602. The fixing unit 600 further comprises main heaters 603A and 604A, sub-heaters 603B and 604B, external heating rollers 605A and 605B, thermistors 606A and 606B, peeling off claws 607A and 607B, cleaning units 608 and 609, and a guide 610.

The fixing roller 601 and the fixing roller 602 are the "first and second fixing rollers" of the Claims, and they are cylindrical in shape. The main heater 603A and the sub-heater 603B are housed in the interior of the fixing roller 601, and heat up the fixing roller 601 from its inside. And the main heater 604A and the sub-heater 604B are housed in the interior of the fixing roller 602, and heat up the fixing roller 602 from its inside. The external heaters 605A and 605B house heaters in cylindrical external members. The external heater 605A contacts against a portion of the circumferential surface of the fixing roller 601, and heats up the circumferential surface of the fixing roller 601. And the external heater 605B contacts against a portion of the circumferential surface of the fixing roller 602, and heats up the circumferential surface of the fixing roller 602. The main heater 603A and the sub-heater 603B are the "first heater" of the Claims, while the main heater 604A and the sub-heater 604B are the "second heater" of the Claims.

The thermistor 606A and the thermistor 606B respectively detect the temperatures of the fixing roller 601 and of the fixing roller 602, and output detection signals. And the peel off claw 607A and the peel off claw 607B peel off paper sheets from the circumferential surfaces of the fixing roller 601 and the fixing roller 602, respectively.

The cleaning unit 608 and the cleaning unit 609 are the "first and second cleaning members" of the Claims. The cleaning unit 608 comprises a supply roller 608A, a take up roller 608B, a pressure roller 608C, a tension roller 608D, another tension roller 608E, and a web sheet 608F. The supply roller 608A contains the unused portion of the web sheet 608F, wound up. The take up roller 608B winds up the web sheet 608F after it has been used. And the pressure roller 608C is pressed in contact against a portion of the fixing roller 601.

The web sheet 608F passes from the supply roller 608A in order over the tension roller 608D, the pressure roller 608C, and the tension roller 608E, and is then wound up upon the take up roller 608B. The tension roller 608D and the tension roller 608E apply tension to the web sheet 608F. When the web sheet 608F is passing between the pressure roller 608C and the fixing roller 601, it wipes away dirt and dust such as toner or paper powder adhering to the circumferential surface of the fixing roller 601.

Similarly, the cleaning unit 609 comprises a supply roller 609A, a take up roller 609B, a pressure roller 609C, a tension roller 609D, another tension roller 609E, and a web sheet 609F. The supply roller 609A contains the unused portion of the web sheet 609F, wound up. The take up roller 609B winds up the web sheet 609F after it has been used. And the pressure roller 609C is pressed in contact against a portion of the fixing roller 601.

The web sheet 609F passes from the supply roller 609A in order over the tension roller 609D, the pressure roller 609C, and the tension roller 609E, and is then wound up upon the take up roller 609B. The tension roller 609D and the tension roller 609E apply tension to the web sheet 609F. When the web sheet 609F is passing between the pressure roller 609C and the fixing roller 602, it wipes away dirt and dust such as toner or paper powder adhering to the circumferential surface of the fixing roller 602.

Each of the components included in the cleaning unit 608 is the same as a corresponding one of the components included in the cleaning unit 609, and the cleaning unit 608 and the cleaning unit 609 are structured symmetrically on either side of the paper conveyance path, sandwiching it between them. By thus reducing the number of components which must be provided for the fixing unit 600 and thereby making the structure more compact, it is possible to anticipate a reduction in cost.

By the web sheets 608F and 609F wiping away dirt and dust from the circumferential surfaces of the fixing rollers 601 and 602, it is possible to prevent spoiling of the paper sheets which pass between the fixing roller 601 and the fixing roller 602. Among the web sheets 608F and 609F, at least the web sheet 608F is impregnated with release agent such as silicon oil or the like. The web sheet 608F applies this release agent to the circumferential surface of the fixing roller 601. Accordingly, the cleaning unit 608 also functions as the "application member" of the Claims.

While a paper sheet is passing between the fixing roller 601 and the fixing roller 602, a color image consisting of a plurality of layers of toner which have been transcribed onto this paper sheet by the color processing unit 300 is pressed into contact with the circumferential surface of the fixing roller 601. By the release agent being applied to the circumferential surface of the fixing roller 601, the toner which makes up this color image is prevented from adhering to the circumferential surface of the fixing roller 601 while the paper sheet is passing between the fixing roller 601 and the fixing roller 602.

It should be understood that it would also be acceptable to impregnate the web sheet 609F with release agent as well, so as likewise to prevent the toner which has been transcribed to the paper sheet by the monochrome processing unit 400 from adhering to the circumferential surface of the fixing roller 602.

The guide 610 is disposed between the transfer unit 500 and the fixing unit 600. This guide member 610 is made in approximately a flat plate shape, and can swing freely around a shaft 611 which extends in a direction orthogonal to the conveyance direction of the paper sheets (the direction shown by the arrow sign Y). This guide member 610 deflects the conveyance direction of the paper sheet which has passed the transfer unit 500 towards the side of the fixing roller 601 or the side of the fixing roller 602, by swinging in the counterclockwise in FIG. 2 or in the clockwise, respectively.

Figure 8:
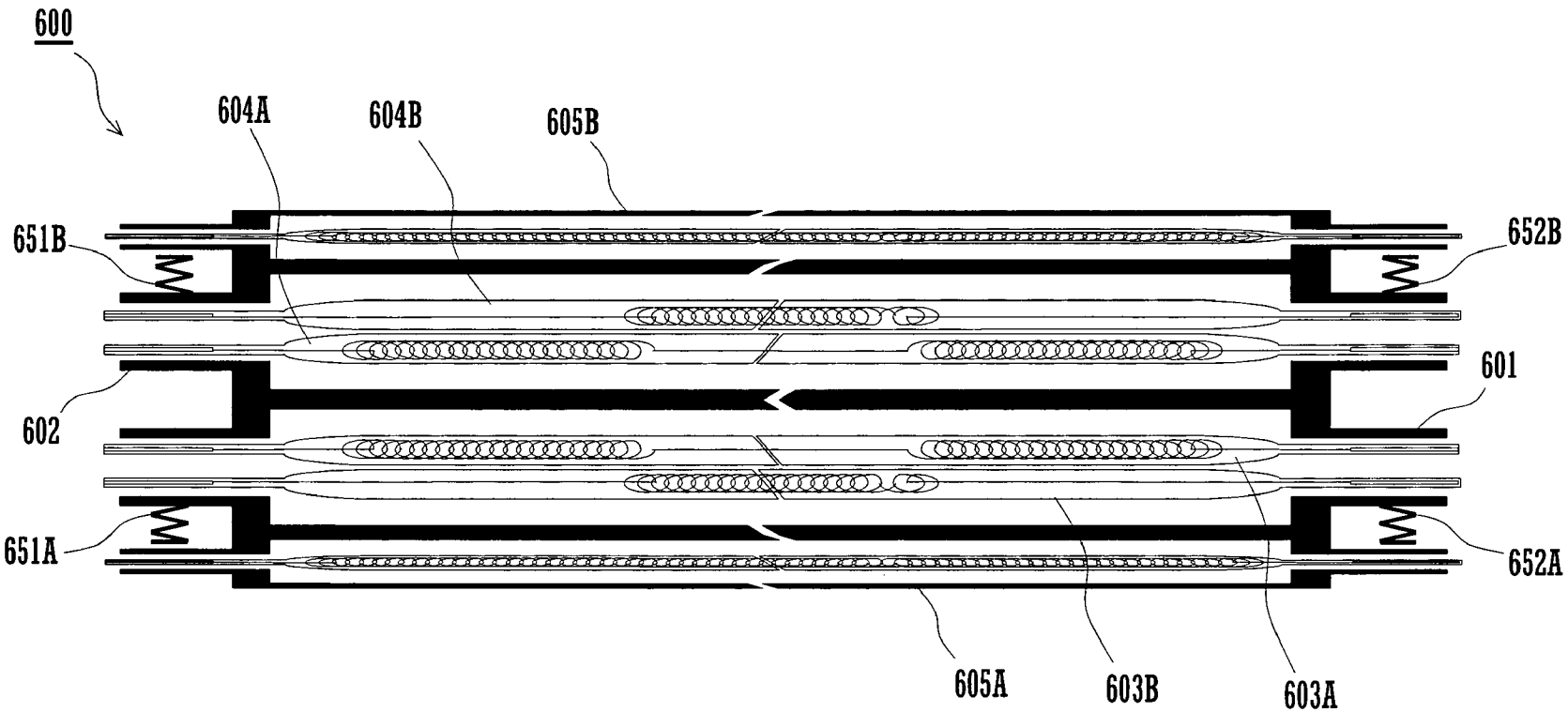
FIG. 8 is a side view of the fixing unit.

FIG. 8 is a side sectional view of this fixing unit 600 of the image forming apparatus 100. The lengths along the X axis parallel to the direction orthogonal to the direction of conveyance of the paper sheet of the fixing roller 601 and the fixing roller 602 are made to be longer than the short side of the maximum size of paper sheet to be conveyed within this image forming apparatus 100 (for example, A3 size). Heat application portions of the main heaters 603A and 604A are disposed at central portions along this X axis, and heat application portions of the sub-heaters 603B and 604B are disposed at both end portions of a range along this X axis. The range over which the heat application portions of the main heaters 603A and 604A are disposed is approximately equal to the length of the short side of the smallest size of paper sheet to be conveyed within this image forming apparatus 100 (for example, A4 size).

The lengths of the external heaters 305A and 305B along the X axis are approximately equal to the length of the fixing rollers 601 and 602.

During image formation upon a paper sheet of a small size, it is possible to reduce the consumption of electrical power by driving only the main heater 603A or the main heater 604A.

Springs 651A and 652A are provided at both end portions of the fixing roller 601. Due to the elastic force of these springs 651A and 652A, the fixing roller 601 is biased towards the side of the fixing roller 602. And springs 651B and 652B are provided at both end portions of the fixing roller 602. Due to the elastic force of these springs 651B and 652B, the fixing roller 602 is biased towards the side of the fixing roller 601. With this structure, the circumferential surfaces of the fixing roller 601 and the fixing roller 602 are pressed into contact at their one portions.

The fixing roller 601 and the fixing roller 602 are made from the same material, in the same shape. Accordingly, the surface hardness of both of them is the same, and the nip portion between both of them is approximately a plane. The paper sheet which is passing through this planar shaped nip portion between the fixing roller 601 and the fixing roller 602 receives application of heat and pressurization. During both color image formation and monochrome image formation, the state in which the paper sheet passes between the fixing roller 601 and the fixing roller 602 does not change, so that the paper sheet can always be conveyed in a stable manner, and so that it is possible to maintain a satisfactory state of image formation upon the paper sheet.

It should be understood that it would be possible to omit either the springs 651A and 652A, or the springs 651B and 652B, under the condition that the nip portion between the fixing roller 601 and the fixing roller 602 is planar and of approximately constant width over its entire area along the X direction.

Figure 9:
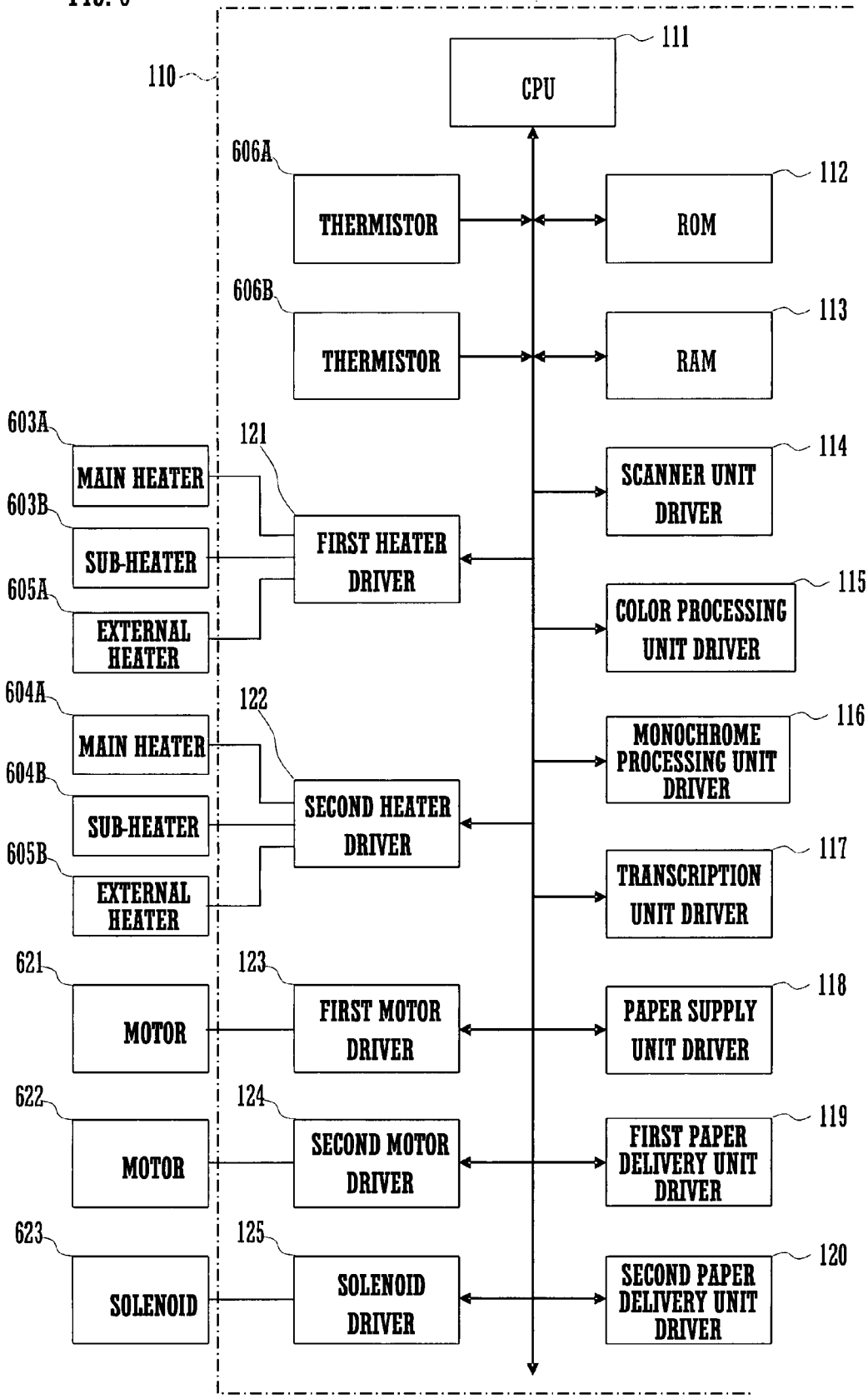
FIG. 9 is a block diagram of a control unit of the image forming apparatus.

FIG. 9 is a block diagram showing the structure of the control unit 110 of the image forming apparatus 100. This control unit 110 comprises, along with a scanner unit driver 114, a color processing unit driver 115, a monochrome processing unit driver 116, a transfer unit driver 117, a paper supply unit driver 118, a first paper delivery unit driver 119, and a second paper delivery unit driver 120, also a first heater drier 121, a second heater driver 122, a first motor driver 123, a second motor driver 124, a solenoid driver 125, thermistors 606A and 606B, and so on, all connected to a CPU 111 which comprises a ROM 112 and a RAM 113.

The CPU 111 controls the drivers and so on as a whole, according to a program which is stored in the ROM 112. The data inputted and outputted at this time is stored in the RAM 113. The scanner unit driver 114 drives a device such as a motor or the like which is included in the scanner unit 200, based upon drive data outputted from the CPU 111. The color processing unit driver 115 drives devices such as motors and clutches and so on which are included in the color processing unit 300, based upon drive data outputted from the CPU 111. And the monochrome processing unit driver 116 drives devices such as motors and clutches and so on which are included in the monochrome processing unit 400, based upon drive data outputted from the CPU 111.

Moreover, the transfer unit driver 117 drives a device such as a motor and the like which is included in the transfer unit 500, based upon drive data outputted from the CPU 111. The paper supply unit driver 118 drives devices such as motors and clutches and so on which are included in the paper supply unit 700, based upon drive data outputted from the CPU 111. The first paper delivery unit driver 119 drives a device such as a motor or the like which is included in the first paper delivery unit 800, based upon drive data outputted from the CPU 111. And the second paper delivery unit driver 120 drives a device such as a motor or the like which is included in the second paper delivery unit 900, based upon drive data outputted from the CPU 111.

The signals detected by the thermistors 606A and 606B are inputted to the CPU 111. Based upon these detection signals from the thermistors 606A and 606B, the CPU 111 outputs drive data to the first heater driver 121 and to the second heater driver 122.

The main heater 603A, the sub-heater 603B, and the external heater 605A are connected to the first heater driver 121. And the first heater driver 121 drives the main heater 603A, the sub-heater 603B, and the external heater 605A based upon drive data outputted from the CPU 111. Likewise, the main heater 604A, the sub-heater 604B, and the external heater 605B are connected to the second heater driver 122. And the second heater driver 122 drives the main heater 604A, the sub-heater 604B, and the external heater 605B based upon drive data outputted from the CPU 111.

A motor 621 which supplies rotation to the fixing roller 601 is connected to the first motor driver 123. And the first motor driver 123 drives the motor 621 based upon drive data outputted from the CPU 111. Likewise, a motor 622 which supplies rotation to the fixing roller 602 is connected to the second motor driver 124. And the second motor driver 124 drives the motor 622 based upon drive data outputted from the CPU 111.

A solenoid 623 which swings the guide 610 is connected to the solenoid driver 125. And the solenoid driver 125 drives the solenoid 623 based upon drive data outputted from the CPU 111.

The control unit 110 also serves as the "drive changeover unit" of the Claims. When a color image is to be formed by the color processing unit 300, the CPU 111 outputs drive data to the first heater driver 121, the first motor driver 123, and the solenoid driver 125. And, when a monochrome image is to be formed by the monochrome processing unit 400, the CPU 111 outputs drive data to the second heater driver 122 and the second motor driver 124.

It should be understood that it would also be acceptable to provide a single motor to the fixing unit 600, and two clutches, one for the fixing roller 601 and one for the fixing roller 602, these clutches being alternatively engaged or disengaged. In this case, the engaged and disengaged states of the two clutches would be changed over between a period of color image formation, and a period of monochrome image formation.

The amount of electrical power consumed by the main heaters 603A and 604A may be, for example, 700 W; the amount of electrical power consumed by the sub-heaters 603B and 604B may be, for example, 200 W; and the amount of electrical power consumed by the external heaters 605A and 605B may be, for example, 300 W.

During formation of a color image, the CPU 111 drives the main heater 603A, the sub-heater 603B, and the external heater 605A, while, during formation of a monochrome image, it drives the main heater 604A, the sub-heater 604B, and the external heater 605B. Accordingly, the amount of electrical power consumed by the fixing unit 600 during image formation does not exceed the rated power level of the image forming apparatus 100.

Actuation data which indicates the details of actuation of an actuation unit not shown in the figures is inputted to the CPU 111. Furthermore, image data including an image formation request may be inputted to the CPU 111 from an external device via an interface not shown in the figures.

The control unit 110 controls the motor 511 so as to rotate the drive roller 503 in the clockwise in FIG. 4. At this time, the first gate 509, which is the "changeover means", is rotated in the counterclockwise, so that a sheet of paper which is supplied from the paper supply unit 700 and is adjusted at between the paper stop rollers 714 is changed over to the conveyance direction in the left direction of the conveyance belt 502, and this sheet of paper is conveyed towards the first opposing portion 512. When a single transfer unit is shared in common by the two processing units in this manner, the drive mechanism of the conveyance mechanism, and its drive control, can be simplified.

Figure 10:
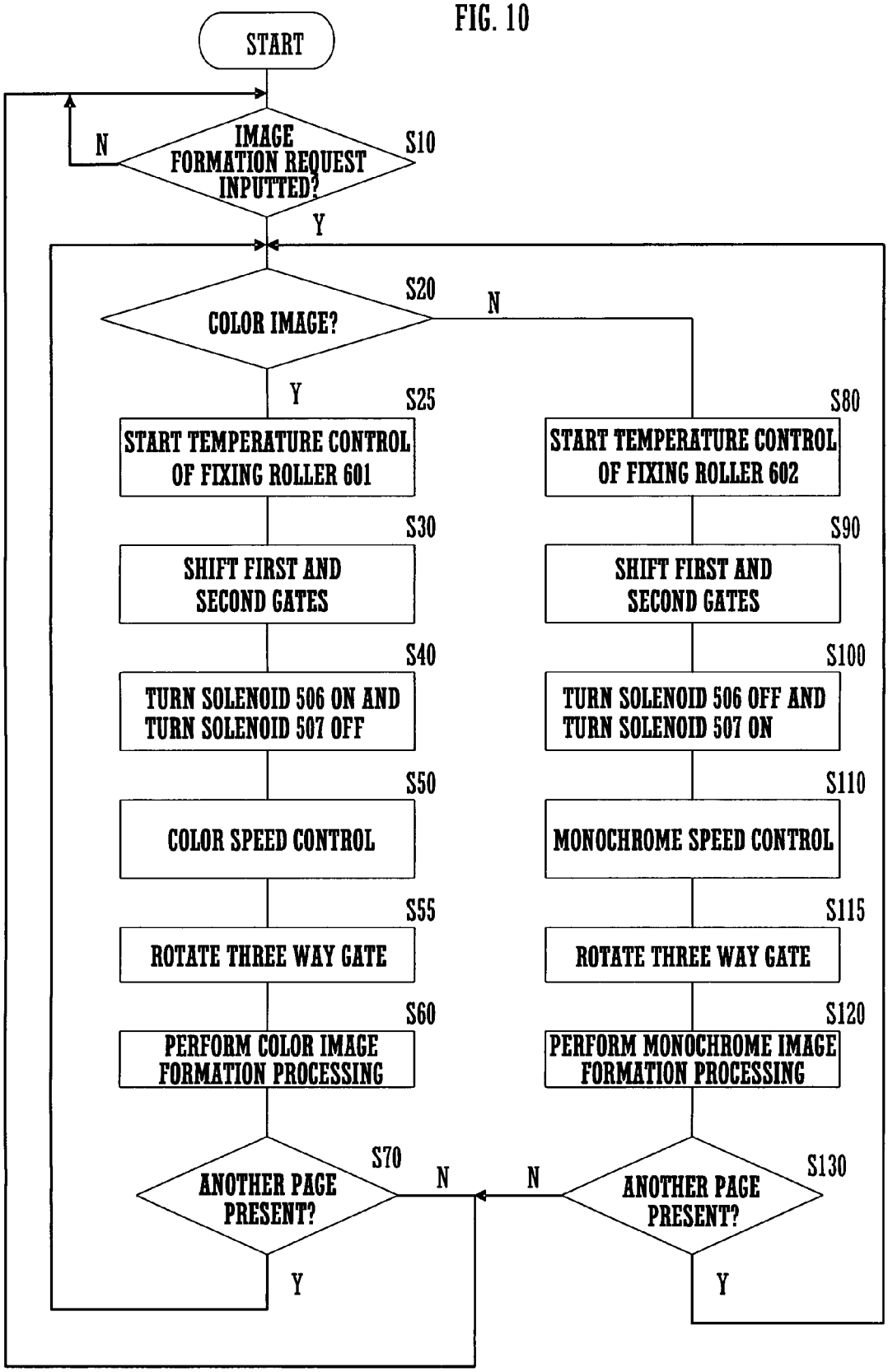
FIG. 10 is a flow chart showing the sequence of processing by the control unit, during both color and monochrome image formation.

FIG. 10 is a flow chart showing the control flow executed by the control unit of this image forming apparatus 100. If an image formation request is detected by the image forming apparatus 100 (step S10), CPU 111 make a decision as to whether this image formation request is a request for monochrome image formation or a request for color image formation (step S20).

If color image formation has been decided upon, then control of the surface temperature of the fixing roller 601 (i.e. power supply control to the heater 603) is started (step S25). The first gate 509 and the second gate 510 are shifted to their positions shown in FIG. 5 (step S30), the solenoid 506 is turned ON, the solenoid 507 is turned OFF, and the transfer device 501 is pressed into contact with the intermediate transfer belt 317, via the conveyance belt 502 (step S40).

Next, the drive roller 503 is rotated in the clockwise, and the rotational direction and the rotational speed of the motor 511 are set (step S50) so that the conveyance speed of the conveyance belt 502 agrees with the image formation processing speed of the color processing unit 300. If face down discharge has been commanded in advance by the operator, then, in order to direct the paper sheets upon which fixing has been completed to the first paper delivery unit 800, the three way gate 1301 is rotated from its initial state shown in FIG. 2A in the counterclockwise, and is changed over to its state as shown in FIG. 2C.

On the other hand, if face up discharge has been commanded in advance by the operator, then, in order to direct the paper sheets upon which fixing has been completed to the second paper delivery unit 900, the three way gate 1301 is rotated from its initial state shown in FIG. 2A in the clockwise, and is changed over to its state as shown in FIG. 2B (step S55). And color image formation processing is performed upon one sheet of paper (step S60). The presence or absence of an image formation request for a subsequent page is checked (step S70), and, if such a further image formation request is present, then the flow of control returns back to the step S20, and image formation processing is continued. If there is no such image formation request, then the flow of control returns back to the step S10, and the next printing request is awaited.

On the other hand, if in the step S20 monochrome image formation has been decided upon, then control of the surface temperature of the fixing roller 602 (i.e. power supply control to the heater 604) is started (step S80). The first gate 509 and the second gate 510 are shifted to their positions shown in FIG. 6 (step S90), the solenoid 506 is turned OFF, the solenoid 507 is turned ON, and the transfer device 415 is pressed into contact with the circumferential surface of the photoreceptor drum 411, via the conveyance belt 502 (step S100). Next, the drive roller 503 is rotated in the counterclockwise, and the rotational direction and the rotational speed of the motor 511 are set (step S110) so that the conveyance speed of the conveyance belt 502 agrees with the image formation processing speed of the monochrome processing unit 400.

If face down discharge has been commanded in advance by the operator, then, in order to direct the paper sheets upon which fixing has been completed to the second paper delivery unit 900, the three way gate 1301 is rotated from its initial state shown in FIG. 2A in the clockwise, and is changed over to its state as shown in FIG. 2B. On the other hand, if face up discharge has been commanded in advance by the operator, then, in order to direct the paper sheets upon which fixing has been completed to the first paper delivery unit 800, the three way gate 1301 is rotated from its initial state shown in FIG. 2A in the counterclockwise, and is changed over to its state as shown in FIG. 2C (step S115). And monochrome image formation processing is performed upon one sheet of paper (step S120). The presence or absence of an image formation request for a subsequent page is checked (step S130), and, if such a further image formation request is present, then the flow of control returns back to the step S20, and image formation processing is continued. If there is no such further image formation request, then the flow of control returns back to the step S10, and the next printing request is awaited.

Figure 11:
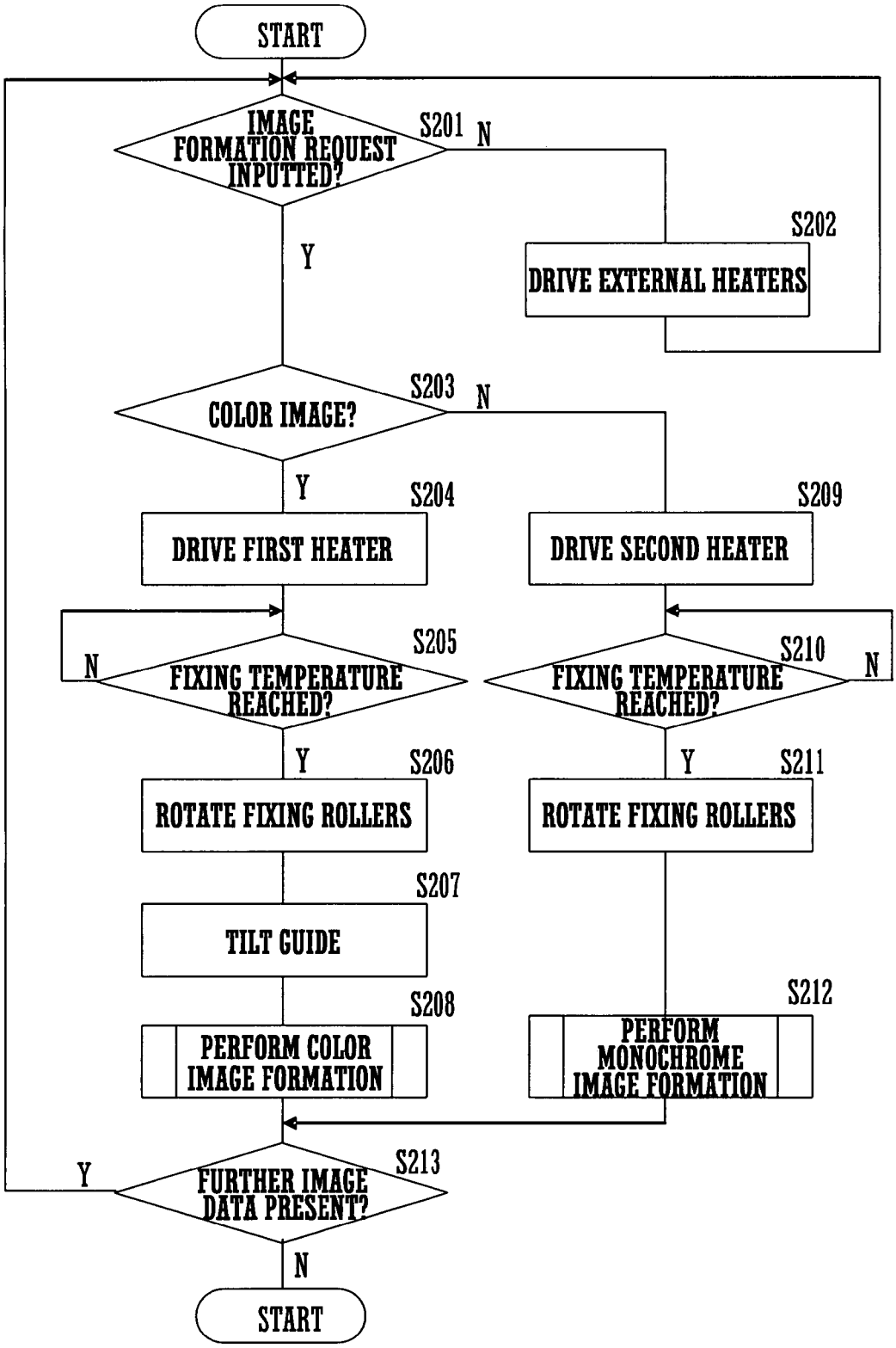
FIG. 11 is a flow chart showing the details of surface temperature control during the processing sequence by the control unit.

FIG. 11 is a flow chart showing the details of surface temperature control for the fixing rollers during the processing sequence by the control unit 110. The CPU 111 waits (step S201) for a command for image formation to be issued by actuation of the actuation unit, or for an image formation request to be inputted from an external device along with image data. During this waiting process, the CPU 111 drives the external heaters 605A and 605B so that the temperatures of the fixing rollers 601 and 602 become temperatures during waiting which are set in advance (step S202). When an image formation request is inputted, the CPU 111 makes a decision as to whether the image to be created is a color image or is a monochrome image (step S203).

If the image to be created is a color image, then the CPU 111 drives the main heater 603A the sub-heater 603B, and the external heater 605A (step S4), so that the temperature of the fixing roller 601 attains a predetermined fixing temperature. At this time, the CPU 111 stops driving the external heater 605B.

And, when the temperature of the fixing roller 601 reaches a predetermined fixing temperature (step S205), then the CPU 111, along with driving the motor 621 and rotating the fixing roller 601 (step S206), also drives the solenoid 623 and tilts the guide 610 (step S207), and performs color image formation with the color processing unit 300 (step S208). The fixing roller 601 rotates at a speed which matches the speed of processing by the color processing unit 300.

On the other hand, if the image to be created is a monochrome image, then the CPU 111 drives the main heater 604A (step S209), the sub-heater 604B, and the external heater 605B, so that the temperature of the fixing roller 602 attains a predetermined fixing temperature. At this time, the CPU 111 stops driving the external heater 605A.

And, when the temperature of the fixing roller 602 reaches a predetermined fixing temperature (step S210), then the CPU 111, along with driving the motor 622 and rotating the fixing roller 602 (step S211), also performs monochrome image formation with the monochrome processing unit 400 (step S212). At this time, the CPU 111 does not drive any of the solenoids. The fixing roller 602 rotates at a speed which matches the speed of processing by the monochrome processing unit 400.

After the processing of the steps S204 to S208, or the processing of the steps S209 to S212, next, the CPU 111 makes a decision as to whether or not subsequent image data to used for formation of an image is present (step S213). And the CPU 111 repeatedly executes the processing of the steps S4-S8, or the processing of the steps S209 to S212, until there is no further image data to be used for image formation. When there is no further image data to be used for image formation, the CPU 111 returns to the waiting state.

During the waiting period when image formation is not to be performed by either the color processing unit 300 or the monochrome processing unit 400, the external heaters 605A and 605B are driven, so that the fixing rollers 601 and 602 are raised to their waiting temperature. In the case of forming a color image with the color processing unit 300, the fixing roller 601 which is contacted with the surface of the paper sheet upon which the color image has been transcribed is heated up with the main heater 603A, the sub-heater 603B, and the external heater 605A. The opposite surface of the paper sheet to its side upon which the color image has been transcribed is contacted against the fixing roller 602 which is raised only to its waiting temperature. Thus, the color image which has been transcribed to the paper sheet is reliably melted and fixed to the paper sheet.

On the other hand, in the case of forming a monochrome image with the monochrome processing unit 400, the fixing roller 602 which is contacted with the surface of the paper sheet upon which the monochrome image has been transcribed is heated up with the main heater 604A, the sub-heater 604B, and the external heater 605B. The opposite surface of the paper sheet to its side upon which the monochrome image has been transcribed is contacted against the fixing roller 601 which is raised only to its waiting temperature. The monochrome image which has been transcribed to the paper sheet is thus reliably melted and fixed to the paper sheet.

The waiting temperature is a lower temperature than the fixing temperature. In the case of forming images continuously upon a large number of sheets of paper with the color processing unit 300, it would also be acceptable to drive the external heater 605B and heat up the fixing roller 602, so as to apply a sufficient amount of heat to the paper sheets which are passing the fixing unit 600 continuously. In the same manner, in the case of forming images continuously upon a large number of sheets of paper with the monochrome processing unit 400, it would also be acceptable to drive the external heater 605A and heat up the fixing roller 601, so as to apply a sufficient amount of heat to the paper sheets which are passing the fixing unit 600 continuously.

Figure 12:
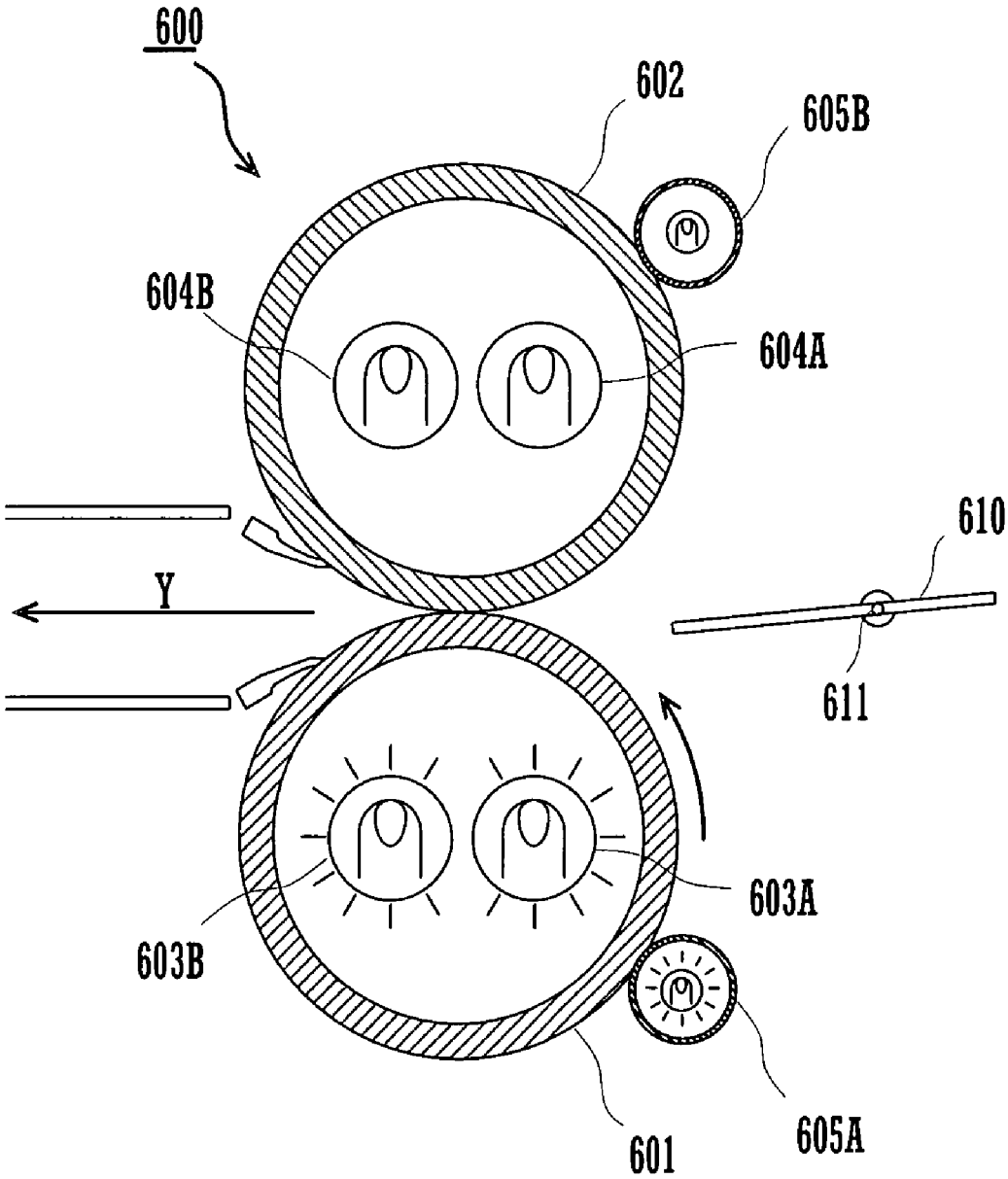
FIG. 12 is a figure showing a situation during color image formation by the fixing unit.

FIG. 12 is a front sectional view showing the state of the principal portions of the fixing unit 600 during color image formation. During color image formation by the color processing unit 300, when conveying a paper sheet of a small size, the main heater 603A and the external heater 605A are driven; while, by contrast, when conveying a paper sheet of a large size, the main heater 603A, the sub-heater 603B, and the external heater 605A are driven, so that the fixing roller 601 is raised to its fixing temperature. The guide 610 deflects the conveyance direction for the paper sheet to the side of the fixing roller 601, so that the surface of the paper sheet upon which the color image has been transcribed is first contacted against the fixing roller 601. Furthermore, the fixing roller 601 is driven by the motor 621, while the fixing roller 602 is driven by the rotation of the fixing roller 601.

Before the color image which has been transcribed to the paper sheet arrives between the fixing roller 601 and the fixing roller 602, it contacts against the surface of the fixing roller 601 which is at a higher temperature than the fixing roller 602. The paper sheet bearing the color image is thus conducted in a preheated state between the fixing roller 601 and the fixing roller 602. Furthermore, after having passed between the fixing roller 601 and the fixing roller 602, the paper sheet becomes easy to peel off from the surface of the fixing roller 601.

Figure 13:
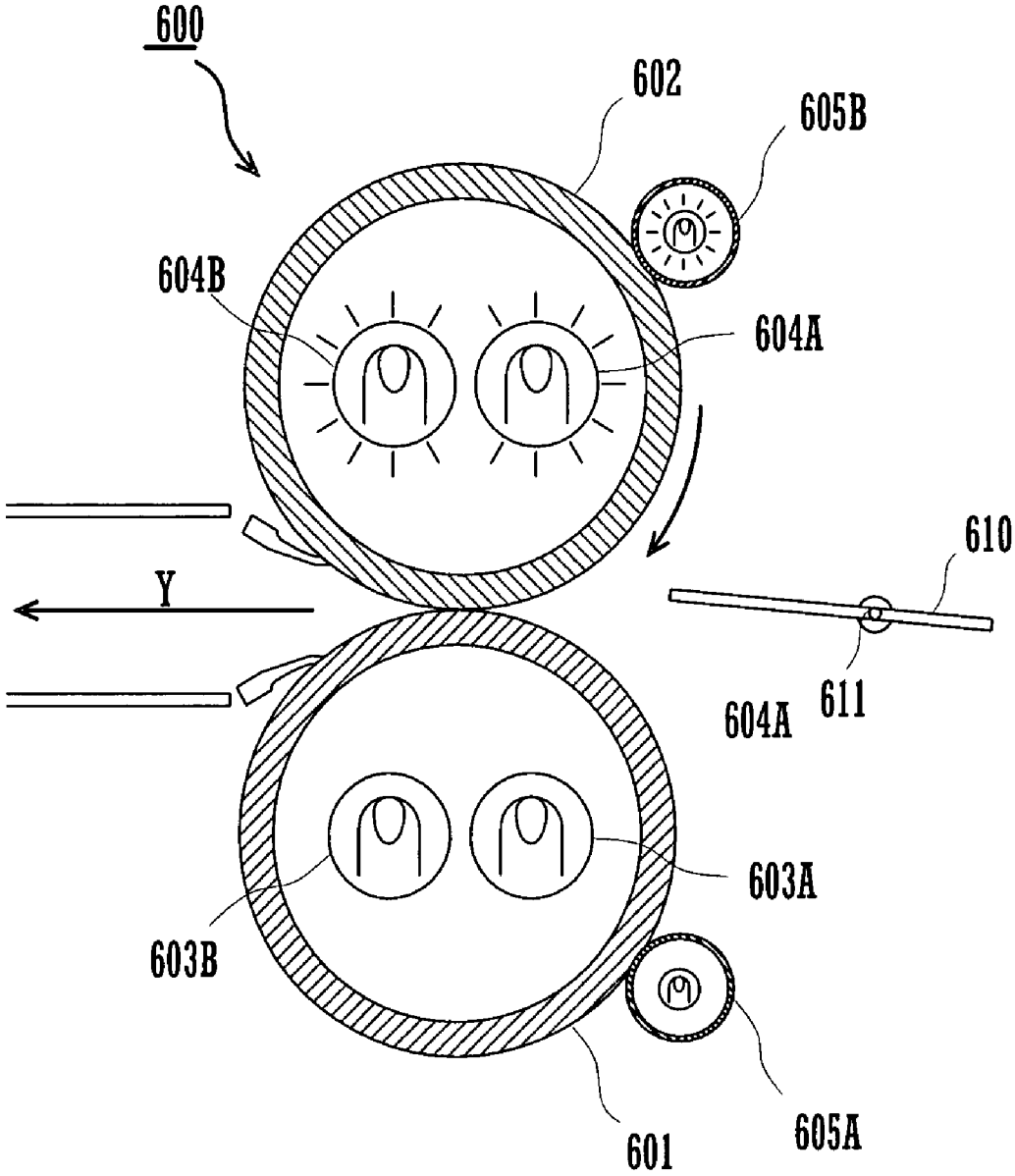
FIG. 13 is a figure showing a situation during monochrome image formation by the fixing unit.

FIG. 13 is a front sectional view showing the state of the principal portions of the fixing unit 600 during monochrome image formation. During monochrome image formation by the monochrome processing unit 400, when conveying a paper sheet of a small size, the main heater 604A and the external heater 605B are driven; while, by contrast, when conveying a paper sheet of a large size, the main heater 604A, the sub-heater 604B, and the external heater 605B are driven, so that the fixing roller 602 is raised to its fixing temperature. The guide 610 deflects the conveyance direction for the paper sheet to the side of the fixing roller 602, so that the surface of the paper sheet upon which the monochrome image has been transcribed is first contacted against the fixing roller 602. Furthermore, the fixing roller 602 is driven by the motor 622, while the fixing roller 601 is driven by the rotation of the fixing roller 602.

Before the monochrome image which has been transcribed to the paper sheet arrives between the fixing roller 601 and the fixing roller 602, it contacts against the surface of the fixing roller 602 which is at a higher temperature than the fixing roller 601. The paper sheet bearing the monochrome image is thus conducted in a preheated state between the fixing roller 601 and the fixing roller 602. Furthermore, after having passed between the fixing roller 601 and the fixing roller 602, the paper sheet becomes easy to peel off from the surface of the fixing roller 602.

The control unit 110 changes over which of the fixing roller 601 and the fixing roller 602 it performs heat application processing and pressurization processing by, according as to whether it is fixing an image upon the first surface of the paper sheet which is passing between the fixing roller 601 and the fixing roller 602 or upon on its second surface. Along with this, the control unit 110 drives either the fixing roller 601 or the fixing roller 602, alternatively.

By doing this, during color image formation, heat is applied to the color image and the heat application processing is performed principally by the fixing roller 601 against which the color image is contacted, while the color image is pressurized and the pressurization processing is performed principally by the fixing roller 602 which is pressed into contact with the fixing roller 601. On the other hand, during monochrome image formation, heat is applied to the monochrome image and the heat application processing is performed principally by the fixing roller 602 against which the monochrome image is contacted, while the monochrome image is pressurized and the pressurization processing is performed principally by the fixing roller 601 which is pressed into contact with the fixing roller 602.

Due to the use of the single fixing unit 600 which includes the pair of fixing rollers 601 and 602, it is possible to fix either a color image which has been formed by the color processing unit 300, or a monochrome image which has been formed by the monochrome processing unit 400, to the surface of the paper, alternatively.

Furthermore, the fixing roller 601 against which the color image is contacted is driven during color image formation, while the fixing roller 602 against which the monochrome image is contacted is driven during monochrome image formation. Due to this, no disparity arises between the conveyance speed of the paper sheet and the peripheral speed of the fixing roller on the side at which the image is contacted, so that it is possible to prevent blur of the image.

Figure 14:
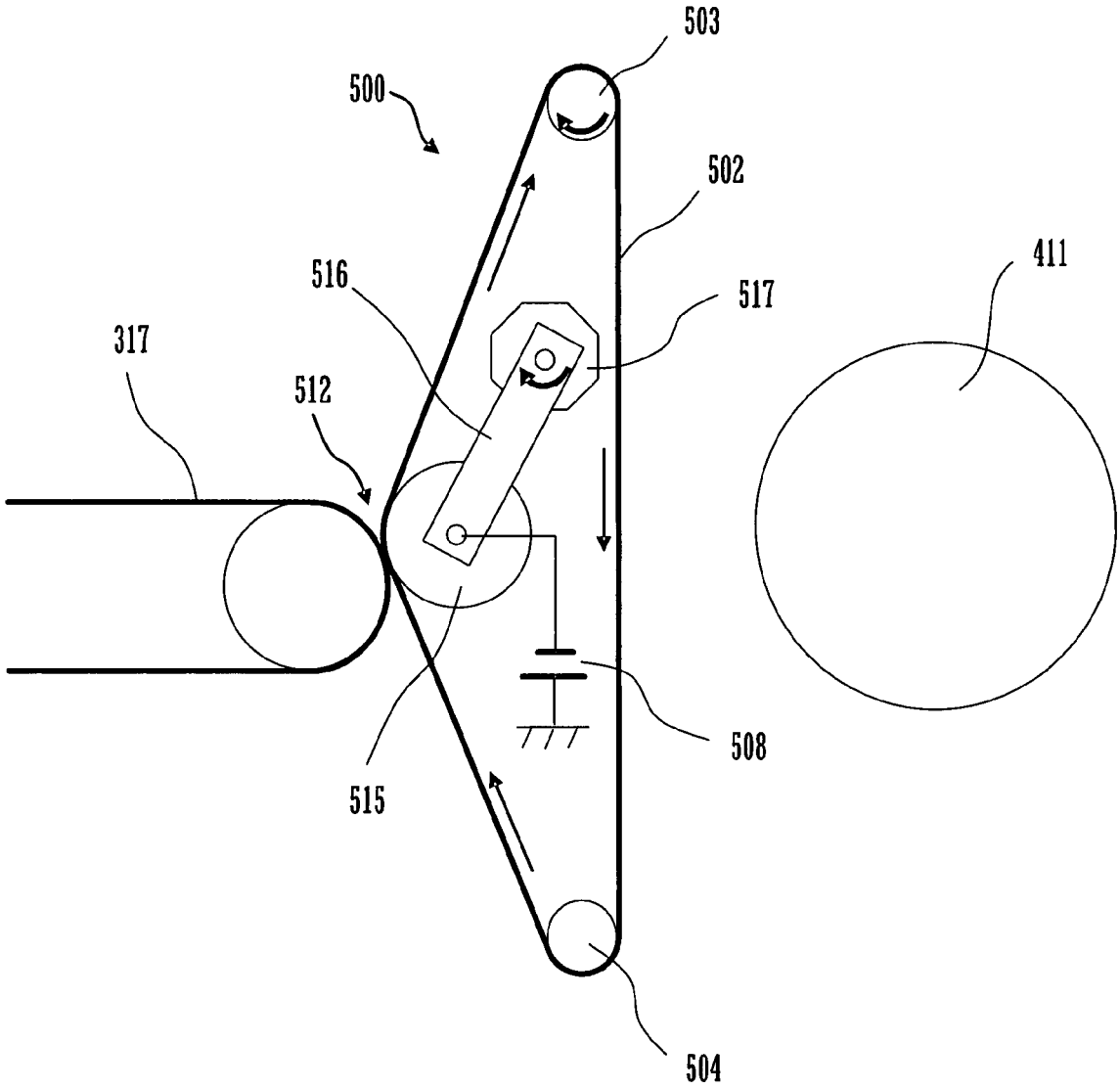
FIG. 14 is a figure showing the operation of an image forming apparatus according to another embodiment of the present invention, during color image formation.
Figure 15:
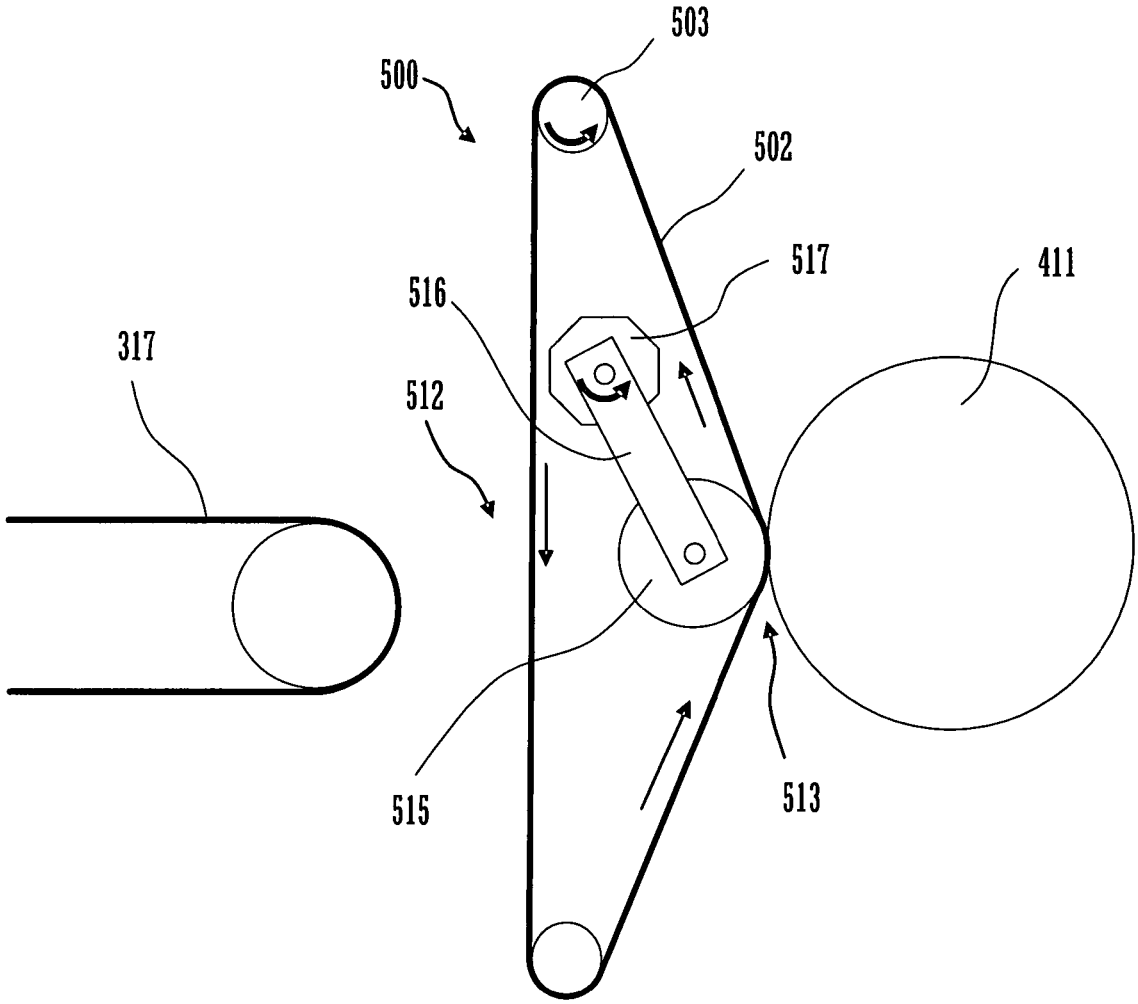
FIG. 15 is a figure showing the operation of this image forming apparatus according to this other embodiment of the present invention, during monochrome image formation.

FIGS. 14 and 15 are figures showing the detailed structure of a transfer unit 500 of an image forming apparatus according to another embodiment of the present invention. This transfer unit 500 comprises a transfer device 515, an arm 516 which is a support member and rotatably supports the transfer device 515, a motor 517 which is a shift member and is linked to the arm 516 so as to shift the transfer device 515, a conveyance belt 502, a drive roller 503, and a driven roller 504. The transfer device 515 is, by way of example, a transfer roller. It should be understood that the transfer device 515 is a member which is electrically conductive, and, although here it is a roller, it would also be acceptable for it to be a plate shaped member. The conveyance belt 502, the high voltage power supply 508, the drive roller 503, and the driven roller 504 have the same functions as previously explained, and accordingly explanation thereof will be omitted.

The situation when forming a toner image with the color processing unit 300 and performing transfer thereof to a paper sheet is shown in FIG. 14. The motor 517 is rotated in the clockwise, so that the end portion of the arm 516 which supports the transfer device 515 is shifted in the leftwards direction in FIG. 14, and the transfer device 515 is pressed into contact against the intermediate transfer belt 317 via the conveyance belt 502, while at the same time the transfer device 515 is removed away from the photoreceptor drum 411. And the color toner image upon the intermediate transfer belt 317 is transcribed to the paper sheet which has been conveyed to arrive at the first opposing portion 512.

Figure 16:
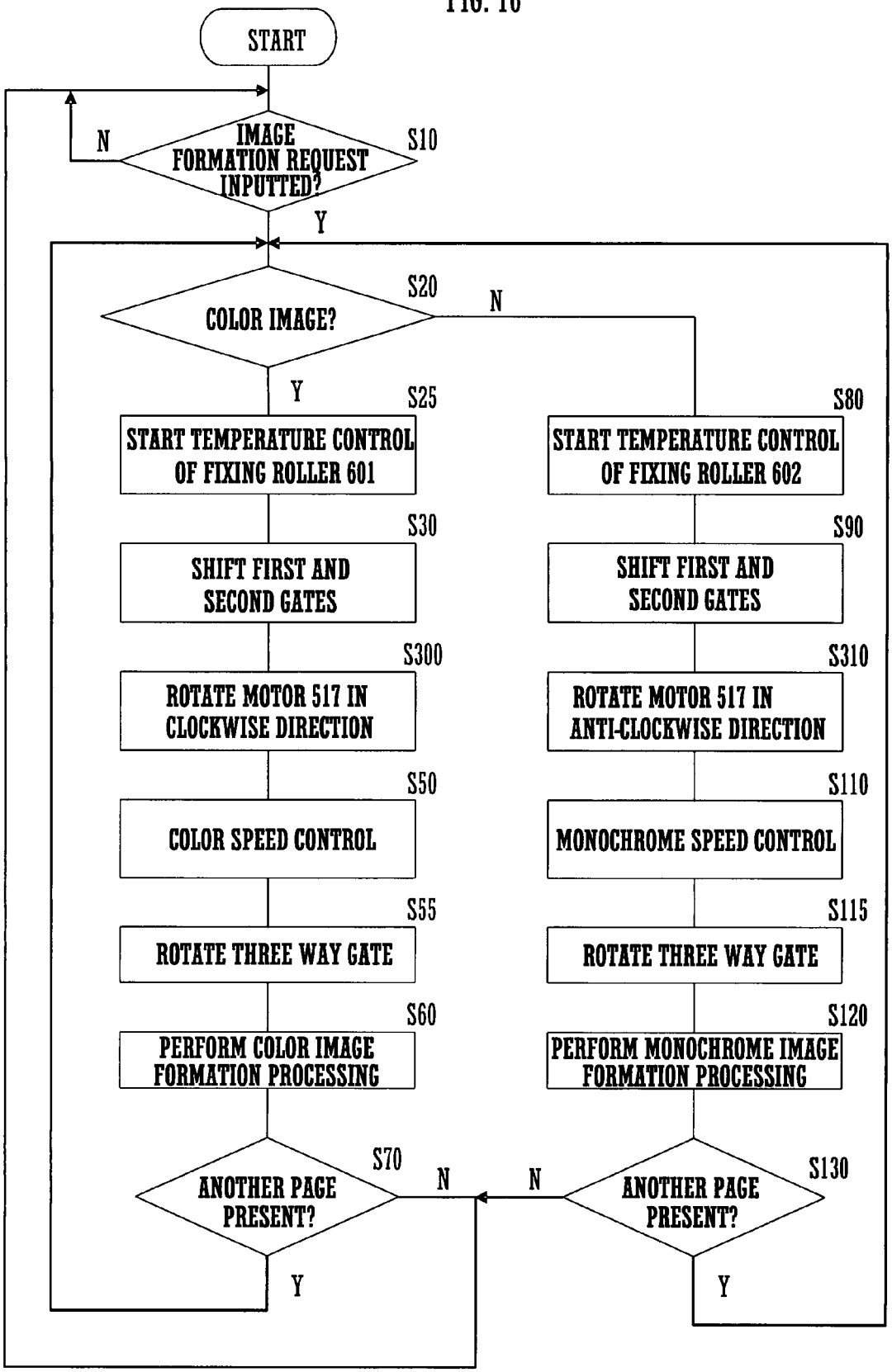
FIG. 16 is a flow chart showing the sequence of processing by this image forming apparatus according to this other embodiment of the present invention, during both color and monochrome image formation.

On the other hand, the situation when forming a toner image with the monochrome processing unit 400 and performing transfer thereof to a paper sheet is shown in FIG. 15. The motor 517 is rotated in the counterclockwise, so that the end portion of the arm 516 which supports the transfer device 515 is shifted in the rightwards direction in FIG. 15, and the transfer device 515 is removed away from the intermediate transfer belt 317, while at the same time the transfer device 515 is pressed into contact against the photoreceptor drum 411, via the conveyance belt 502. And the monochrome toner image upon the photoreceptor drum 411 is transcribed to the paper sheet which has been conveyed to arrive at the second opposing portion 513. In this manner, it is possible to make the transfer mechanism more compact and more simple, due to the transfer device 515 being utilized in common by the two processing units. FIG. 16 shows the control flow which is performed by the control unit 110 of this image forming apparatus according to the other embodiment of the present invention. The steps to which the same reference symbols are appended as in FIG. 10 are the same as previously described, and explanation thereof will be omitted. However, the steps S200 and S210, which are steps to which different reference symbols are appended from the ones in FIG. 10, will now be explained. In the step S300, during color image formation, the motor 517 is rotated in the clockwise, and the end portion of the arm 516 which supports the transfer device 515 is shifted in the leftward direction, so as to establish the state of the apparatus shown in FIG. 14. By contrast, in the step S310, during monochrome image formation, the motor 517 is rotated in the counterclockwise, and the end portion of the arm 516 which supports the transfer device 515 is shifted in the rightward direction, so as to establish the state of the apparatus shown in FIG. 15.

Although the structure of the present invention is as described above, as variations of the structure described, it would also be acceptable for the color processing unit to include four development devices and only a single photoreceptor drum, and to utilize a method of superimposing four colors upon the intermediate transfer belt 317 (a four turns processing method). Furthermore, it would also be acceptable for the color processing unit to include four development devices and only a single photoreceptor drum, and to utilize a method in which superimposition of image data in four colors upon the photoreceptor drum is performed, with this image data which has been superimposed upon the photoreceptor drum then being transcribed onto the paper sheet by a single transfer process.

Finally, in the explanation of an embodiment of the present invention, all of the features are shown by way of example, and should not be considered as being limitative of the present invention. The scope of the present invention is not to be defined by any of the features of the embodiment described above, but only by the scope of the appended Claims. Moreover, equivalents to elements in the Claims, and variations within their legitimate and proper scope, are also to be considered as being included within the range of the present invention.

What is claimed is:

1. An image forming apparatus, comprising:

a paper supply unit which supplies recording medium;

a paper delivery unit which stores the recording medium for which image formation processing has been completed;

a conveyance path, along which the recording medium is conveyed from the paper supply unit to the paper delivery unit;

first and second processing units comprising respective first and second image carrying members, upon which toner images are formed by developing image data;

a transfer unit which transcribes a toner image from the first or second image carrying member, to the recording medium which is being conveyed upon the conveyance path; and a fixing unit which fixes the toner image upon the recording medium in the conveyance path, between the transfer unit and the paper delivery unit;

wherein the conveyance path includes first and second main conveyance paths which branch apart between the paper supply unit and the transfer unit, and come together between the transfer unit and the fixing unit;

the image forming apparatus further comprising a conveyance direction changeover member, provided upon the conveyance path, which selectively conveys paper supplied from the paper supply unit to either one of the first and second main conveyance path, according to the image data; and wherein:

the first and second processing units are provided in such a manner that the first and second image carrying members sandwich therebetween the first and second main conveyance paths and are situated close to each other, the first processing unit forms the toner image with toners of a plurality of colors, and the second processing unit forms the toner image with toner of a single color; and the transfer unit is provided between the first and second main conveyance paths, and selectively generates a transfer electric field between itself and the first or second image carrying member, according to the image data.

2. The image forming apparatus described in claim 1, further comprising a conveyance direction change member which changes the conveyance direction of the recording medium from the first and second main conveyance paths to the fixing unit.

3. The image forming apparatus described in claim 1, wherein:

the first processing unit forms the toner image with toners of a plurality of colors by image formation processing according to a method of electrophotography; and the second processing unit forms the toner image with toner of a single color by image formation processing according to a method of electrophotography.

4. An image forming apparatus, comprising:

a paper supply unit which supplies recording medium;

a paper delivery unit which stores the recording medium for which image formation processing has been completed;

a conveyance path, along which the recording medium is conveyed from the paper supply unit to the paper delivery unit;

first and second processing units comprising respective first and second image carrying members, upon which toner images are formed by developing image data;

a transfer unit which transcribes a toner image from the first or second image carrying member, to the recording medium which is being conveyed upon the conveyance path; and a fixing unit which fixes the toner image upon the recording medium in the conveyance path, between the transfer unit and the paper delivery unit;

wherein the conveyance path includes first and second main conveyance paths which branch apart between the paper supply unit and the transfer unit, and come together between the transfer unit and the fixing unit;

the image forming apparatus further comprising a conveyance direction changeover member, provided upon the conveyance path, which selectively conveys paper supplied from the paper supply unit to either one of the first and second main conveyance path, according to the image data; and wherein:

the first and second processing units are provided in such a manner that the first and second image carrying members sandwich therebetween the first and second main conveyance paths, the transfer unit selectively generates a transfer electric field between itself and the first or second image carrying member, according to the image data, the first and second processing units differ in image formation processing speed, and the image forming apparatus further comprising a control unit which controls the conveyance speed of the recording medium along the first and second main conveyance paths so as to accord with the image formation processing speeds.

5. An image forming apparatus, comprising:

a paper supply unit which supplies recording medium;

a paper delivery unit which stores the recording medium for which image formation processing has been completed;

a conveyance path, along which the recording medium is conveyed from the paper supply unit to the paper delivery unit;

first and second processing units comprising respective first and second image carrying members, upon which toner images are formed by developing image data;

a transfer unit which transcribes a toner image from the first or second image carrying member, to the recording medium which is being conveyed upon the conveyance path; and a fixing unit which fixes the toner image upon the recording medium in the conveyance path, between the transfer unit and the paper delivery unit;

wherein the conveyance path includes first and second main conveyance paths which branch apart between the paper supply unit and the transfer unit, and come together between the transfer unit and the fixing unit;

the image forming apparatus further comprising a conveyance direction changeover member, provided upon the conveyance path, which selectively conveys paper supplied from the paper supply unit to either one of the first and second main conveyance path, according to the image data; and wherein:

the first and second processing units are provided in such a manner that the first and second image carrying members sandwich therebetween the first and second main conveyance paths;

the transfer unit selectively generates a transfer electric field between itself and the first or second image carrying member, according to the image data;

the conveyance path comprises a conveyance belt, which is an endless belt included in the first and second main conveyance paths, and which is extended over and driven by a plurality of rollers so as to move along a loop shaped path; and the transfer unit is disposed on the inside of the loop shaped path.

6. The image forming apparatus described in claim 5, wherein the transfer unit comprises first and second transfer devices which are disposed so as to approach the first and second image carrying members, respectively.

7. The image forming apparatus described in claim 6, further comprising a high voltage power supply which applies a common transfer voltage to the first and second transfer devices.

8. The image forming apparatus described in claim 5, wherein the plurality of rollers comprise:

a first roller which is disposed in the conveyance path where the first and second main conveyance paths branch apart, and which is grounded; and a second roller which is disposed in the conveyance path where the first and second main conveyance paths come together, and which is set to an electrically floating state.

9. The image forming apparatus described in claim 5, further comprising a drive source which drives one or another of the plurality of rollers in such a manner that the direction of rotation of the plurality of rollers is selectively reversed according to the image data.

10. The image forming apparatus described in claim 6, wherein the transfer unit comprises:

a support member which supports the first and second transfer devices; and a shift member which shifts the support member, so that the endless belt is pressed into contact with a one of the first and the second image carrying member upon which a toner image is formed, with a pressing contact force adapted to create a transfer region capable of transcribing the toner image onto the recording medium.

11. The image forming apparatus described in claim 10, wherein the shift member shifts the support member so as to hold that one of the first and second image carrying member upon which no toner image is formed at a predetermined distance away from the endless belt.

12. The image forming apparatus described in claim 11, wherein the predetermined distance is a distance at which toner which remains upon the one of the first and second image carrying member upon which no toner image is formed is not transcribed to the endless belt by the electric field which the first or second transfer device creates.

13. The image forming apparatus described in claim 11, wherein the predetermined distance is a distance at which electric charge originating in the electric field is not imparted to the one of the first and second image carrying member upon which no toner image is formed.

14. An image forming apparatus, comprising:

a paper supply unit which supplies recording medium;

a paper delivery unit which stores the recording medium for which image formation processing has been completed;

a conveyance path, along which the recording medium is conveyed from the paper supply unit to the paper delivery unit;

first and second processing units comprising respective first and second image carrying members, upon which toner images are formed by developing image data;

a transfer unit which transcribes a toner image from the first or second image carrying member, to the recording medium which is being conveyed upon the conveyance path; and a fixing unit which fixes the toner image upon the recording medium in the conveyance path, between the transfer unit and the paper delivery unit;

wherein the conveyance path includes first and second main conveyance paths which branch apart between the paper supply unit and the transfer unit, and come together between the transfer unit and the fixing unit;

the image forming apparatus further comprising a conveyance direction changeover member, provided upon the conveyance path, which selectively conveys paper supplied from the paper supply unit to either one of the first and second main conveyance path, according to the image data; and wherein:

the first and second processing units are provided in such a manner that the first and second image carrying members sandwich therebetween the first and second main conveyance paths; and the transfer unit selectively generates a transfer electric field between itself and the first or second image carrying member, according to the image data; and wherein the fixing unit comprises:

first and second fixing rollers, past which the recording medium passes, one of which principally performs heat processing upon the recording medium by application of heat thereto, and one of which principally performs pressurization processing upon the recording medium by pressurizing it;

first and second heaters which respectively heat up the first and second fixing rollers; and a drive changeover unit which drives the first or second heater, alternatively, according to whether a toner image formed by the first processing unit or a toner image formed by the second processing unit has been transcribed to the recording medium.

15. The image forming apparatus described in claim 14, further comprising first and second cleaning members which respectively clean the surfaces of the first and second fixing rollers.

16. The image forming apparatus described in claim 14, having a symmetrical structure on opposite sides of the conveyance path.

17. The image forming apparatus described in claim 14, wherein the consumption of electrical power by the first and second heaters during the image formation is less than or equal to the rated electrical power of the image forming apparatus.

18. The image forming apparatus described in claim 14, wherein the first and second processing units differ in image formation processing speed, and further comprising a control unit which controls the conveyance speed of the recording medium by the first and second fixing rollers, so as to accord with the image formation processing speeds.

19. The image forming apparatus described in claim 14, wherein:

the first processing unit creates the toner image in a plurality of colors by image formation processing according to a method of electrophotography; and the second processing unit creates the toner image in a single color by image formation processing according to a method of electrophotography.

20. The image forming apparatus described in claim 19, further comprising an application member which applies a release agent to the surface of that one of the first and second fixing rollers which performs heating processing during image formation based upon color image data.

* * * * *